US008300862B2

(12) United States Patent
Newton et al.

(10) Patent No.: US 8,300,862 B2
(45) Date of Patent: Oct. 30, 2012

(54) WIRELESS INTERFACE FOR PROGRAMMING HEARING ASSISTANCE DEVICES

(75) Inventors: James Newton, Burnsville, MN (US); Mark Seel, Roseville, MN (US); Matthias Müllenborn, Smoerum (DK); Per Kokholm Sørensen, Smoerum (DK); Garry Richardson, Colorado Springs, CO (US)

(73) Assignees: Starkey Kaboratories, Inc, Eden Prairie, MN (US); Oticon A/S, Hellerup (DK)

( * ) Notice: Subject to any disclaimer, the term of this patent is extended or adjusted under 35 U.S.C. 154(b) by 140 days.

(21) Appl. No.: 11/857,283

(22) Filed: Sep. 18, 2007

(65) Prior Publication Data

US 2008/0137888 A1 Jun. 12, 2008

Related U.S. Application Data

(60) Provisional application No. 60/845,565, filed on Sep. 18, 2006.

(51) Int. Cl.
*H04R 25/00* (2006.01)

(52) U.S. Cl. ..... 381/314; 381/324

(58) Field of Classification Search ..... 381/312, 381/314, 315, 322, 323, 306, 388, 60; 710/300–302, 710/69, 8–14, 72–73; 700/94
See application file for complete search history.

(56) References Cited

U.S. PATENT DOCUMENTS 3,527,901 A 9/1970 Geib
4,188,667 A 2/1980 Graupe et al.
4,366,349 A 12/1982 Adelman
4,396,806 A 8/1983 Anderson
4,419,544 A 12/1983 Adelman
4,425,481 A 1/1984 Mansgold et al.
4,471,490 A 9/1984 Bellafiore
4,548,082 A 10/1985 Engebretson et al.
4,606,329 A 8/1986 Hough
4,617,429 A 10/1986 Bellafiore
4,628,907 A 12/1986 Epley (Continued)

FOREIGN PATENT DOCUMENTS

AU 2007216810 7/2011

(Continued)

OTHER PUBLICATIONS

"Module." Computer Desktop Encyclopedia. TechEncyclopedia. Computer Language Company Inc., 2011. Answers.com Aug. 25, 2011. http://www.answers.com/topic/module.*

(Continued)

*Primary Examiner* — Davetta W. Goins
*Assistant Examiner* — Phylesha Dabney
(74) *Attorney, Agent, or Firm* — Schwegman, Lundberg & Woessner, P.A.

(57) ABSTRACT

Provided herein is a device for wirelessly communicating with hearing assistance devices. According to various embodiments, the device includes a first interface for communicating with a programmer and a second interface for wirelessly communicating with a hearing assistance device. The second interface is adapted to receive a plurality of communication modules. Each of the modules is adapted for communication with at least one specific type of hearing assistance device. The device includes a housing for the first interface, the second interface, and electrical connections between the interfaces. The housing adapted to be worn around the neck of a person wearing the hearing assistance device.

21 Claims, 11 Drawing Sheets

U.S. PATENT DOCUMENTS

| | | | |
|---|---|---|---|
| 4,634,815 | A | 1/1987 | Marquis |
| 4,636,876 | A | 1/1987 | Schwartz |
| 4,637,402 | A | 1/1987 | Adelman |
| 4,652,702 | A | 3/1987 | Yoshii |
| 4,657,106 | A | 4/1987 | Hardt |
| 4,680,799 | A | 7/1987 | Henneberger |
| 4,682,248 | A | 7/1987 | Schwartz |
| 4,689,820 | A | 8/1987 | Kopke et al. |
| 4,706,778 | A | 11/1987 | Topholm |
| 4,712,245 | A | 12/1987 | Lyregaard |
| 4,731,850 | A | 3/1988 | Levitt et al. |
| 4,735,759 | A | 4/1988 | Bellafiore |
| 4,755,889 | A | 7/1988 | Schwartz |
| 4,756,312 | A | 7/1988 | Epley |
| 4,760,778 | A | 8/1988 | Simelunas et al. |
| 4,763,752 | A | 8/1988 | Haertl et al. |
| 4,776,322 | A | 10/1988 | Hough et al. |
| 4,791,672 | A | 12/1988 | Nunley et al. |
| 4,800,982 | A | 1/1989 | Carlson |
| 4,811,402 | A | 3/1989 | Ward |
| 4,815,138 | A | 3/1989 | Dietelm |
| 4,817,609 | A | 4/1989 | Perkins et al. |
| 4,834,211 | A | 5/1989 | Bibby et al. |
| 4,867,267 | A | 9/1989 | Carlson |
| 4,869,339 | A | 9/1989 | Barton |
| 4,870,688 | A | 9/1989 | Voroba et al. |
| 4,870,689 | A | 9/1989 | Weiss |
| 4,879,749 | A | 11/1989 | Levitt et al. |
| 4,879,750 | A | 11/1989 | Nassler |
| 4,880,076 | A | 11/1989 | Ahlberg et al. |
| 4,882,762 | A | 11/1989 | Waldhauer |
| 4,887,299 | A | 12/1989 | Cummins et al. |
| 4,920,570 | A | 4/1990 | West et al. |
| 4,937,876 | A | 6/1990 | Biermans |
| 4,947,432 | A | 8/1990 | Topholm |
| 4,953,215 | A | 8/1990 | Weiss et al. |
| 4,961,230 | A | 10/1990 | Rising |
| 4,962,537 | A | 10/1990 | Basel et al. |
| 4,966,160 | A | 10/1990 | Birck et al. |
| 4,972,487 | A | 11/1990 | Mangold et al. |
| 4,972,488 | A | 11/1990 | Weiss et al. |
| 4,972,492 | A | 11/1990 | Tanaka et al. |
| 4,975,967 | A | 12/1990 | Rasmussen |
| 4,977,976 | A | 12/1990 | Major |
| 4,989,251 | A | 1/1991 | Mangold |
| 5,002,151 | A | 3/1991 | Oliveira et al. |
| 5,003,607 | A | 3/1991 | Reed |
| 5,003,608 | A | 3/1991 | Carlson |
| 5,008,943 | A | 4/1991 | Arndt et al. |
| 5,012,520 | A | 4/1991 | Steeger |
| 5,014,016 | A | 5/1991 | Anderson |
| 5,016,280 | A | 5/1991 | Engebretson et al. |
| 5,027,410 | A | 6/1991 | Williamson et al. |
| 5,033,090 | A | 7/1991 | Weinrich |
| 5,044,373 | A | 9/1991 | Northeved et al. |
| 5,046,580 | A | 9/1991 | Barton |
| 5,048,077 | A | 9/1991 | Wells et al. |
| 5,048,092 | A | 9/1991 | Yamagishi et al. |
| 5,061,845 | A | 10/1991 | Pinnavaia |
| 5,068,902 | A | 11/1991 | Ward |
| 5,083,312 | A | 1/1992 | Newton et al. |
| 5,101,435 | A | 3/1992 | Carlson |
| 5,111,419 | A | 5/1992 | Morley, Jr. et al. |
| 5,133,016 | A | 7/1992 | Clark |
| 5,142,587 | A | 8/1992 | Kobayashi |
| 5,144,674 | A | 9/1992 | Meyer et al. |
| 5,146,051 | A | 9/1992 | Hermann |
| 5,166,659 | A | 11/1992 | Navarro |
| 5,185,802 | A | 2/1993 | Stanton |
| 5,195,139 | A | 3/1993 | Gauthier |
| 5,197,332 | A | 3/1993 | Shennib |
| 5,201,007 | A | 4/1993 | Ward et al. |
| 5,202,927 | A | 4/1993 | Topholm |
| 5,208,867 | A | 5/1993 | Stites, III |
| 5,210,803 | A | 5/1993 | Martin et al. |
| 5,220,612 | A | 6/1993 | Tibbetts et al. |
| 5,222,151 | A | 6/1993 | Nagayoshi et al. |
| 5,225,836 | A | 7/1993 | Morley, Jr. et al. |
| 5,226,086 | A | 7/1993 | Platt |
| 5,257,315 | A | 10/1993 | Haertl et al. |
| 5,259,032 | A | 11/1993 | Perkins et al. |
| 5,276,739 | A | 1/1994 | Krokstad et al. |
| 5,277,694 | A | 1/1994 | Leysieffer et al. |
| 5,282,253 | A | 1/1994 | Konomi |
| 5,295,191 | A | 3/1994 | Van Vroenhoven |
| 5,298,692 | A | 3/1994 | Ikeda et al. |
| 5,303,305 | A | 4/1994 | Raimo et al. |
| 5,303,306 | A | 4/1994 | Brillhart et al. |
| 5,319,163 | A | 6/1994 | Scott |
| 5,321,757 | A | 6/1994 | Woodfill, Jr. |
| 5,327,500 | A | 7/1994 | Campbell |
| 5,338,287 | A | 8/1994 | Miller et al. |
| 5,343,319 | A | 8/1994 | Moore |
| 5,345,509 | A | 9/1994 | Hofer et al. |
| 5,347,477 | A | 9/1994 | Lee |
| 5,357,251 | A | 10/1994 | Morley, Jr. et al. |
| 5,357,576 | A | 10/1994 | Arndt |
| 5,363,444 | A | 11/1994 | Norris |
| 5,365,593 | A | 11/1994 | Greenwood et al. |
| 5,373,149 | A | 12/1994 | Rasmussen |
| 5,373,555 | A | 12/1994 | Norris et al. |
| 5,381,484 | A | 1/1995 | Claes et al. |
| 5,384,852 | A | 1/1995 | Scharen |
| 5,387,875 | A | 2/1995 | Tateno |
| 5,388,248 | A | 2/1995 | Robinson et al. |
| 5,390,254 | A | 2/1995 | Adelman |
| 5,395,168 | A | 3/1995 | Leenen |
| 5,402,494 | A | 3/1995 | Flippe et al. |
| 5,402,496 | A | 3/1995 | Soli et al. |
| 5,404,407 | A | 4/1995 | Weiss |
| 5,406,619 | A | 4/1995 | Akhteruzzaman et al. |
| 5,416,847 | A | 5/1995 | Boze |
| 5,418,524 | A | 5/1995 | Fennell |
| 5,420,930 | A | 5/1995 | Shugart, III |
| 5,422,855 | A | 6/1995 | Eslick et al. |
| 5,425,104 | A | 6/1995 | Shennib |
| 5,434,924 | A | 7/1995 | Jampolsky |
| 5,440,449 | A | 8/1995 | Scheer |
| 5,445,525 | A | 8/1995 | Broadbent et al. |
| 5,448,637 | A | 9/1995 | Yamaguchi et al. |
| 5,475,759 | A | 12/1995 | Engebretson |
| 5,479,522 | A | 12/1995 | Lindemann et al. |
| 5,481,616 | A | 1/1996 | Freadman |
| 5,487,161 | A | 1/1996 | Koenck et al. |
| 5,488,668 | A | 1/1996 | Waldhauer |
| 5,500,901 | A | 3/1996 | Geraci et al. |
| 5,500,902 | A | 3/1996 | Stockham, Jr. et al. |
| 5,502,769 | A | 3/1996 | Gilbertson |
| 5,515,424 | A | 5/1996 | Kenney |
| 5,515,443 | A | 5/1996 | Meyer |
| 5,530,763 | A | 6/1996 | Aebi et al. |
| 5,531,787 | A | 7/1996 | Lesinski et al. |
| 5,533,029 | A | 7/1996 | Gardner |
| 5,535,282 | A | 7/1996 | Luca |
| 5,540,597 | A | 7/1996 | Budman et al. |
| 5,544,222 | A | 8/1996 | Robinson et al. |
| 5,546,590 | A | 8/1996 | Pierce |
| 5,553,151 | A | 9/1996 | Goldberg |
| 5,553,152 | A | 9/1996 | Newton |
| 5,555,490 | A | 9/1996 | Carroll |
| 5,559,501 | A | 9/1996 | Barzegar et al. |
| 5,561,446 | A | 10/1996 | Montlick |
| 5,563,400 | A | 10/1996 | Le Roux |
| 5,572,594 | A | 11/1996 | Devoe et al. |
| 5,572,683 | A | 11/1996 | Epolite et al. |
| 5,574,654 | A | 11/1996 | Bingham et al. |
| 5,581,747 | A | 12/1996 | Anderson |
| 5,590,373 | A | 12/1996 | Whitley et al. |
| 5,602,925 | A | 2/1997 | Killion |
| 5,603,096 | A | 2/1997 | Gilhousen et al. |
| 5,604,812 | A | 2/1997 | Meyer |
| 5,606,620 | A | 2/1997 | Weinfurtner |
| 5,606,621 | A | 2/1997 | Reiter et al. |
| 5,615,344 | A | 3/1997 | Corder |
| 5,619,396 | A | 4/1997 | Gee et al. |
| 5,626,629 | A | 5/1997 | Faltys et al. |
| 5,640,490 | A | 6/1997 | Hansen et al. |

5,645,074 A 7/1997 Shennib et al.
5,649,001 A 7/1997 Thomas et al.
5,659,621 A 8/1997 Newton
5,664,228 A 9/1997 Mital
5,666,125 A 9/1997 Luxon et al.
5,671,368 A 9/1997 Chan et al.
5,677,948 A 10/1997 Meister
5,696,970 A 12/1997 Sandage et al.
5,696,993 A 12/1997 Gavish
5,708,720 A 1/1998 Meyer
5,710,819 A 1/1998 Topholm et al.
5,710,820 A 1/1998 Martin et al.
5,717,771 A 2/1998 Sauer et al.
5,717,818 A 2/1998 Nejime et al.
5,721,783 A 2/1998 Anderson
5,736,727 A 4/1998 Nakata et al.
5,737,706 A 4/1998 Seazholtz et al.
5,738,633 A 4/1998 Christiansen
5,740,165 A 4/1998 Vannucci
5,751,820 A 5/1998 Taenzer
5,757,933 A 5/1998 Preves et al.
5,784,602 A 7/1998 Glass et al.
5,784,628 A 7/1998 Reneris
5,785,661 A 7/1998 Shennib
5,794,201 A 8/1998 Nejime et al.
5,800,473 A 9/1998 Faisandier
5,809,017 A 9/1998 Smith et al.
5,812,936 A 9/1998 DeMont
5,812,938 A 9/1998 Gilhousen et al.
5,814,095 A 9/1998 Muller et al.
5,819,162 A 10/1998 Spann et al.
5,822,442 A 10/1998 Agnew et al.
5,824,022 A 10/1998 Zilberman et al.
5,825,631 A 10/1998 Prchal
5,825,894 A 10/1998 Shennib
5,827,179 A 10/1998 Lichter et al.
5,835,611 A 11/1998 Kaiser et al.
5,842,115 A 11/1998 Dent
5,845,251 A 12/1998 Case
5,852,668 A 12/1998 Ishige et al.
5,861,968 A 1/1999 Kerklaan et al.
5,862,238 A 1/1999 Agnew et al.
5,864,708 A 1/1999 Croft et al.
5,864,813 A 1/1999 Case
5,864,820 A 1/1999 Case
5,870,481 A 2/1999 Dymond et al.
5,878,282 A 3/1999 Mital
5,883,927 A 3/1999 Madsen et al.
5,884,260 A 3/1999 Leonhard
5,887,067 A 3/1999 Costa et al.
5,890,016 A 3/1999 Tso
5,909,497 A 6/1999 Alexandrescu
5,910,997 A 6/1999 Ishige et al.
5,915,031 A 6/1999 Hanright
5,916,174 A 6/1999 Dolphin
5,917,812 A 6/1999 Antonio et al.
5,923,764 A 7/1999 Shennib
5,926,388 A 7/1999 Kimbrough et al.
5,926,500 A 7/1999 Odenwalder
5,929,848 A 7/1999 Albukerk et al.
5,930,230 A 7/1999 Odenwalder et al.
5,956,330 A 9/1999 Kerns
5,960,346 A 9/1999 Holshouser
5,987,513 A 11/1999 Prithviraj et al.
6,002,776 A 12/1999 Bhadkamkar et al.
6,009,311 A 12/1999 Killion et al.
6,009,480 A 12/1999 Pleso
6,016,115 A 1/2000 Heubi
6,016,962 A 1/2000 Nakata et al.
6,021,207 A 2/2000 Puthuff et al.
6,022,315 A 2/2000 Iliff
6,023,570 A 2/2000 Tang et al.
6,032,866 A 3/2000 Knighton et al.
6,035,050 A 3/2000 Weinfurtner et al.
6,041,046 A 3/2000 Scott et al.
6,041,129 A 3/2000 Adelman
6,048,305 A 4/2000 Bauman et al.
6,058,197 A 5/2000 Delage
6,061,431 A 5/2000 Knappe et al.
6,078,675 A 6/2000 Bowen-Nielsen et al.
6,081,629 A 6/2000 Browning
6,084,972 A 7/2000 van Halteren et al.
6,088,339 A 7/2000 Meyer
6,088,465 A 7/2000 Hanright et al.
6,094,492 A 7/2000 Boesen
6,095,820 A 8/2000 Luxon et al.
6,104,822 A 8/2000 Melanson et al.
6,104,913 A 8/2000 McAllister
6,112,103 A * 8/2000 Puthuff ..... 455/557
6,115,478 A 9/2000 Schneider
6,118,877 A 9/2000 Lindemann et al.
6,118,882 A 9/2000 Haynes
6,122,500 A 9/2000 Dent et al.
6,137,889 A 10/2000 Shennib et al.
6,144,748 A 11/2000 Kerns
6,149,605 A 11/2000 Christiansen
6,151,645 A 11/2000 Young et al.
6,157,727 A 12/2000 Rueda
6,167,138 A 12/2000 Shennib
6,181,801 B1 1/2001 Puthuff et al.
6,188,979 B1 2/2001 Ashley
6,198,971 B1 3/2001 Leysieffer
6,201,875 B1 3/2001 Davis et al.
6,205,190 B1 3/2001 Antonio
6,219,427 B1 4/2001 Kates et al.
6,229,900 B1 5/2001 Leenen
6,236,731 B1 5/2001 Brennan et al.
6,240,192 B1 5/2001 Brennan et al.
6,240,193 B1 5/2001 Green
6,240,194 B1 5/2001 De Koning
6,251,062 B1 6/2001 Leysieffer
6,265,102 B1 7/2001 Shrim et al.
6,308,222 B1 10/2001 Krueger et al.
6,317,613 B1 11/2001 Brown, Jr.
6,320,969 B1 11/2001 Killion
6,323,980 B1 11/2001 Bloom
6,324,907 B1 12/2001 Halteren et al.
6,330,233 B1 12/2001 Miya et al.
6,334,072 B1 12/2001 Leysieffer
6,336,863 B1 1/2002 Baerlocher et al.
6,347,148 B1 2/2002 Brennan et al.
6,351,472 B1 2/2002 Meyer
6,366,863 B1 4/2002 Bye et al.
6,366,880 B1 4/2002 Ashley
6,377,925 B1 4/2002 Greene, Jr. et al.
6,379,314 B1 4/2002 Horn
6,389,142 B1 5/2002 Hagen et al.
6,422,471 B2 7/2002 Kowalski
6,424,722 B1 7/2002 Hagen et al.
6,438,245 B1 8/2002 Taenzer et al.
6,449,662 B1 9/2002 Armitage
6,453,051 B1 9/2002 Killion
6,466,678 B1 10/2002 Killion et al.
6,490,427 B2 12/2002 Shields
6,490,627 B1 12/2002 Kalra et al.
6,493,453 B1 12/2002 Glendon
6,545,989 B1 4/2003 Butler
6,554,762 B2 4/2003 Leysieffer
6,557,029 B2 4/2003 Szymansky
6,565,503 B2 5/2003 Leysieffer et al.
6,574,342 B1 6/2003 Davis et al.
6,575,894 B2 6/2003 Leysieffer et al.
6,584,356 B2 6/2003 Wassmund et al.
6,590,986 B1 7/2003 Fazio
6,590,987 B2 7/2003 Delage
6,601,093 B1 7/2003 Peters
6,603,860 B1 8/2003 Taenzer et al.
6,606,391 B2 8/2003 Brennan et al.
6,644,120 B1 11/2003 Braun et al.
6,647,345 B2 11/2003 Bye et al.
6,654,652 B1 11/2003 Dalton et al.
6,658,307 B1 12/2003 Mueller
6,674,867 B2 1/2004 Basseas
6,684,063 B2 1/2004 Berger et al.
6,695,943 B2 2/2004 Juneau et al.
6,697,674 B2 2/2004 Leysieffer
6,704,424 B2 3/2004 Killion
6,707,581 B1 3/2004 Browning

| | | | | |
|---|---|---|---|---|
| 6,717,925 | B1 | 4/2004 | Leppisaari et al. | |
| 6,738,485 | B1 | 5/2004 | Boesen | |
| 6,788,790 | B1 | 9/2004 | Leysieffer | |
| 6,792,114 | B1 | 9/2004 | Kates et al. | |
| 6,823,312 | B2 | 11/2004 | Mittal et al. | |
| 6,850,775 | B1 | 2/2005 | Berg | |
| 6,851,048 | B2 | 2/2005 | Armitage et al. | |
| 6,882,628 | B2 | 4/2005 | Nakagawa et al. | |
| 6,888,948 | B2 | 5/2005 | Hagen et al. | |
| 6,895,345 | B2 | 5/2005 | Bye et al. | |
| 6,913,578 | B2 | 7/2005 | Hou | |
| 6,944,474 | B2 | 9/2005 | Rader et al. | |
| 6,974,421 | B1 | 12/2005 | Causevic et al. | |
| 6,978,155 | B2 | 12/2005 | Berg | |
| 7,016,504 | B1 * | 3/2006 | Shennib | 381/60 |
| 7,054,957 | B2 | 5/2006 | Armitage | |
| 7,200,237 | B2 | 4/2007 | Zhang et al. | |
| 7,451,256 | B2 | 11/2008 | Hagen et al. | |
| 7,787,647 | B2 | 8/2010 | Hagen et al. | |
| 7,929,723 | B2 | 4/2011 | Hagen et al. | |
| 2001/0003542 | A1 | 6/2001 | Kita | |
| 2001/0004397 | A1 | 6/2001 | Kita et al. | |
| 2001/0007050 | A1 | 7/2001 | Adelman | |
| 2001/0009019 | A1 | 7/2001 | Armitage et al. | |
| 2001/0031996 | A1 | 10/2001 | Leysieffer | |
| 2001/0031999 | A1 | 10/2001 | Carter et al. | |
| 2001/0033664 | A1 | 10/2001 | Poux et al. | |
| 2001/0040873 | A1 | 11/2001 | Nakagawa et al. | |
| 2001/0041602 | A1 | 11/2001 | Berger et al. | |
| 2001/0044668 | A1 | 11/2001 | Kimbrough et al. | |
| 2001/0049466 | A1 | 12/2001 | Leysieffer et al. | |
| 2002/0012438 | A1 | 1/2002 | Leysieffer et al. | |
| 2002/0015506 | A1 | 2/2002 | Aceti et al. | |
| 2002/0026091 | A1 | 2/2002 | Leysieffer | |
| 2002/0029070 | A1 | 3/2002 | Leysieffer et al. | |
| 2002/0043545 | A1 * | 4/2002 | Tang | 224/600 |
| 2002/0048374 | A1 | 4/2002 | Soli et al. | |
| 2002/0076073 | A1 | 6/2002 | Taenzer et al. | |
| 2002/0083235 | A1 | 6/2002 | Armitage | |
| 2002/0094098 | A1 | 7/2002 | Delage | |
| 2002/0095292 | A1 | 7/2002 | Mittl et al. | |
| 2002/0111745 | A1 | 8/2002 | Bye et al. | |
| 2002/0150219 | A1 | 10/2002 | Jorgenson et al. | |
| 2002/0165466 | A1 | 11/2002 | Givens et al. | |
| 2002/0168075 | A1 | 11/2002 | Hagen et al. | |
| 2002/0183648 | A1 | 12/2002 | Hou | |
| 2003/0014566 | A1 | 1/2003 | Armitage | |
| 2003/0064746 | A1 | 4/2003 | Rader et al. | |
| 2003/0128859 | A1 | 7/2003 | Greene et al. | |
| 2003/0144603 | A1 | 7/2003 | Zoth et al. | |
| 2003/0162529 | A1 | 8/2003 | Noblins | |
| 2003/0181201 | A1 | 9/2003 | Bomze et al. | |
| 2004/0204921 | A1 | 10/2004 | Bye | |
| 2005/0008175 | A1 | 1/2005 | Hagen et al. | |
| 2005/0196002 | A1 | 9/2005 | Hagen et al. | |
| 2005/0283263 | A1 | 12/2005 | Eaton et al. | |
| 2006/0074572 | A1 | 4/2006 | Bye et al. | |
| 2010/0086153 | A1 | 4/2010 | Hagen et al. | |

FOREIGN PATENT DOCUMENTS

| | | | |
|---|---|---|---|
| DE | 4339898 | | 11/1993 |
| DE | 19541648 | | 5/1997 |
| DE | 19600234 | | 7/1997 |
| DE | 29905172 | | 7/1999 |
| DE | 19815373 | | 10/1999 |
| DE | 19916900 | | 9/2000 |
| DE | 19949604 | | 5/2001 |
| EP | 0341902 | A2 | 11/1989 |
| EP | 0341903 | A2 | 11/1989 |
| EP | 0342782 | A2 | 11/1989 |
| EP | 0363609 | A1 | 4/1990 |
| EP | 0381608 | A2 | 8/1990 |
| EP | 0448764 | A1 | 10/1991 |
| EP | 0537026 | A2 | 4/1993 |
| EP | 0565279 | A2 | 10/1993 |
| EP | 0579152 | A1 | 1/1994 |
| EP | 0632609 | A2 | 1/1995 |
| EP | 0658035 | A2 | 6/1995 |
| EP | 0689755 | A1 | 1/1996 |
| EP | 0726519 | A1 | 8/1996 |
| EP | 0742548 | A2 | 11/1996 |
| EP | 0763903 | A1 | 3/1997 |
| EP | 0765042 | A2 | 3/1997 |
| EP | 0789474 | A2 | 8/1997 |
| EP | 0796035 | A1 | 9/1997 |
| EP | 0800331 | A2 | 10/1997 |
| EP | 0805562 | A2 | 11/1997 |
| EP | 0823829 | A2 | 2/1998 |
| EP | 0831674 | A2 | 3/1998 |
| EP | 0853443 | A2 | 7/1998 |
| EP | 0858180 | A2 | 8/1998 |
| EP | 0873034 | A2 | 10/1998 |
| EP | 0886389 | A2 | 12/1998 |
| EP | 0895364 | A1 | 2/1999 |
| EP | 0737351 | A1 | 3/1999 |
| EP | 0903871 | A2 | 3/1999 |
| EP | 0910191 | A1 | 4/1999 |
| EP | 0936831 | A1 | 8/1999 |
| EP | 0964603 | A1 | 12/1999 |
| EP | 0876717 | B1 | 4/2000 |
| EP | 1191817 | A1 | 3/2002 |
| EP | 0878928 | B1 | 8/2002 |
| EP | 1596633 | A2 | 11/2005 |
| EP | 1398994 | T3 | 4/2012 |
| JP | 1318500 | A | 12/1989 |
| JP | 10210541 | | 8/1998 |
| JP | 11055219 | | 2/1999 |
| JP | 11133998 | | 5/1999 |
| JP | 11196065 | | 7/1999 |
| JP | 2000287299 | | 10/2000 |
| WO | WO-8404195 | A1 | 10/1984 |
| WO | WO-8701851 | A1 | 3/1987 |
| WO | WO-9103042 | A1 | 3/1991 |
| WO | WO-9422372 | A1 | 3/1994 |
| WO | WO-9425958 | A1 | 11/1994 |
| WO | WO-9513685 | A2 | 5/1995 |
| WO | WO-9515712 | A1 | 6/1995 |
| WO | WO-9602097 | A1 | 1/1996 |
| WO | WO-8601671 | A1 | 3/1996 |
| WO | WO-9637086 | A1 | 11/1996 |
| WO | WO-9641498 | A1 | 12/1996 |
| WO | WO-9714266 | A1 | 4/1997 |
| WO | WO-9714267 | A1 | 4/1997 |
| WO | WO-9717819 | A1 | 5/1997 |
| WO | WO-9719573 | A1 | 5/1997 |
| WO | WO-9723062 | A1 | 6/1997 |
| WO | WO-9727682 | A1 | 6/1997 |
| WO | WO-9727712 | A1 | 7/1997 |
| WO | WO-9731431 | A1 | 8/1997 |
| WO | WO-9739537 | A1 | 10/1997 |
| WO | WO-9741653 | A1 | 11/1997 |
| WO | WO-9802969 | A1 | 1/1998 |
| WO | WO-9816086 | A1 | 4/1998 |
| WO | WO-9826513 | A1 | 6/1998 |
| WO | WO-9841030 | A2 | 9/1998 |
| WO | WO-9844648 | A1 | 10/1998 |
| WO | WO-9844667 | A2 | 10/1998 |
| WO | WO-9847313 | A2 | 10/1998 |
| WO | WO-9847314 | A2 | 10/1998 |
| WO | WO-9849785 | A2 | 11/1998 |
| WO | WO-9851124 | A1 | 11/1998 |
| WO | WO-9854928 | A2 | 12/1998 |
| WO | WO-9855833 | A1 | 12/1998 |
| WO | WO-9856106 | A2 | 12/1998 |
| WO | WO-9901994 | A2 | 1/1999 |
| WO | WO-9907302 | A1 | 2/1999 |
| WO | WO-9908457 | A2 | 2/1999 |
| WO | WO-9919779 | A1 | 4/1999 |
| WO | WO-9922550 | A1 | 5/1999 |
| WO | WO-9926392 | A1 | 5/1999 |
| WO | WO-9931935 | A1 | 6/1999 |
| WO | WO-9931937 | A1 | 6/1999 |
| WO | WO-9943105 | A1 | 8/1999 |
| WO | WO-9943185 | A1 | 8/1999 |
| WO | WO-9946912 | A1 | 9/1999 |
| WO | WO-9948330 | A1 | 9/1999 |
| WO | WO-9951057 | A1 | 10/1999 |
| WO | WO-0002418 | A1 | 1/2000 |

| | | | |
|---|---|---|---|
| WO | WO-0010363 | A1 | 2/2000 |
| WO | WO-0016590 | A1 | 3/2000 |
| WO | WO-0019632 | A1 | 4/2000 |
| WO | WO-0021332 | A2 | 4/2000 |
| WO | WO-0022874 | A2 | 4/2000 |
| WO | WO-0036687 | A1 | 6/2000 |
| WO | WO-0036690 | A2 | 6/2000 |
| WO | WO-0036691 | A1 | 6/2000 |
| WO | WO-0036692 | A1 | 6/2000 |
| WO | WO-0128195 | A1 | 4/2001 |
| WO | WO-0135695 | A2 | 5/2001 |
| WO | WO-0139370 | A2 | 5/2001 |
| WO | WO-0145088 | A1 | 6/2001 |
| WO | WO-0151122 | A1 | 7/2001 |
| WO | WO-0154456 | A1 | 7/2001 |
| WO | WO-0154458 | A2 | 7/2001 |
| WO | WO-0169830 | A2 | 9/2001 |
| WO | WO-0176321 | A1 | 10/2001 |
| WO | WO-0193627 | A2 | 12/2001 |
| WO | WO-0197564 | A2 | 12/2001 |
| WO | WO-0209363 | A2 | 1/2002 |
| WO | WO-0209473 | A2 | 1/2002 |
| WO | WO-0230157 | A2 | 4/2002 |
| WO | WO-03063546 | A1 | 7/2003 |

OTHER PUBLICATIONS

"European Application Serial No. 07253666.7, European Search Report mailed Oct. 10, 2008", 7 pgs.
"European Application Serial No. 07253666.7, Office Action Mailed Mar. 27, 2009", 1 pg.
"U.S. Appl. No. 08/782,328, Non Final Office Action mailed Jul. 7, 1998", 7 pgs.
"U.S. Appl. No. 08/896,484, Advisory Action mailed Jan. 29, 2002", 3 pgs.
"U.S. Appl. No. 08/896,484, Final Office Action mailed May 9, 2000", 7 pgs.
"U.S. Appl. No. 08/896,484, Final Office Action mailed Sep. 10, 2001", 14 pgs.
"U.S. Appl. No. 08/896,484, Non Final Office Action mailed Feb. 28, 2001", 16 pgs.
"U.S. Appl. No. 08/896,484, Non Final Office Action mailed Aug. 10, 1999", 6 pgs.
"U.S. Appl. No. 08/896,484, Non Final Office Action mailed Aug. 30, 2000", 16 pgs.
"U.S. Appl. No. 08/896,484, Notice of Allowance mailed Mar. 26, 2002", 4 pgs.
"U.S. Appl. No. 08/896,484, Response filed Feb. 10, 2000 to Non Final Office Action mailed Aug. 10, 1999", 3 pgs.
"U.S. Appl. No. 08/896,484, Response filed Feb. 11, 2002 to Advisory Action mailed Jan. 29, 2002", 6 pgs.
"U.S. Appl. No. 08/896,484, Response filed Jun. 28, 2001 to Non Final Office Action mailed Feb. 28, 2001", 13 pgs.
"U.S. Appl. No. 08/896,484, Response filed Aug. 3, 2000 to Final Office Action mailed May 9, 2000", 3 pgs.
"U.S. Appl. No. 08/896,484, Response filed Nov. 8, 2001 to Final Office Action mailed Sep. 10, 2001", 12 pgs.
"U.S. Appl. No. 08/896,484, Response filed Nov. 30, 2000 to Non Final Office Action mailed Aug. 30, 2000", 4 pgs.
"U.S. Appl. No. 09/004,788, Examiner Interview Summary mailed Oct. 17, 2000", 1 pg.
"U.S. Appl. No. 09/004,788, Final Office Action mailed Mar. 31, 2000", 5 pgs.
"U.S. Appl. No. 09/004,788, Non Final Office Action mailed Mar. 23, 2001", 8 pgs.
"U.S. Appl. No. 09/004,788, Non Final Office Action mailed Jul. 16, 1999", 10 pgs.
"U.S. Appl. No. 09/004,788, Notice of Allowance mailed Oct. 2, 2001", 7 pgs.
"U.S. Appl. No. 09/004,788, Preliminary Amendment mailed Sep. 29, 2000", 6 pgs.
"U.S. Appl. No. 09/004,788, Response filed Jun. 25, 2001 to Non Final Office Action mailed Mar. 23, 2001", 7 pgs.
"U.S. Appl. No. 09/152,416, Final Office Action mailed Apr. 23, 2001", 7 pgs.
"U.S. Appl. No. 09/152,416, Non Final Office Action mailed May 2, 2000", 6 pgs.
"U.S. Appl. No. 09/152,416, Non Final Office Action mailed Nov. 3, 2000", 7 pgs.
"U.S. Appl. No. 09/152,416, Notice of Allowance mailed Apr. 8, 2002", 4 pgs.
"U.S. Appl. No. 09/152,416, Notice of Allowance mailed Oct. 19, 2001", 4 pgs.
"U.S. Appl. No. 09/152,416, Response filed Feb. 5, 2001 to Non Final Office Action mailed Nov. 3, 2000", 5 pgs.
"U.S. Appl. No. 09/152,416, Response filed Sep. 24, 2001 to Final Office Action mailed Apr. 23, 2001", 2 pgs.
"U.S. Appl. No. 09/152,416, Response filed Oct. 2, 2000 to Non Final Office Action mailed May 2, 2000", 7 pgs.
"U.S. Appl. No. 09/492,913, Appeal Brief filed Apr. 2, 2007", 38 pgs.
"U.S. Appl. No. 09/492,913, Appeal Brief filed Apr. 14, 2008", 35 pgs.
"U.S. Appl. No. 09/492,913, Final Office Action mailed Apr. 20, 2005", 21 pgs.
"U.S. Appl. No. 09/492,913, Final Office Action mailed Jun. 2, 2006", 24 pgs.
"U.S. Appl. No. 09/492,913, Non-Final Office Action mailed Jun. 2, 2004", 15 pgs.
"U.S. Appl. No. 09/492,913, Non-Final Office Action mailed Jul. 13, 2007", 20 pgs.
"U.S. Appl. No. 09/492,913, Non-Final Office Action mailed Oct. 26, 2005", 21 pgs.
"U.S. Appl. No. 09/492,913, Preliminary Amendment filed Jan. 20, 2000", 1 pg.
"U.S. Appl. No. 09/492,913, Response filed Feb. 27, 2006 to Non-Final Office Action mailed Oct. 26, 2005", 26 pgs.
"U.S. Appl. No. 09/492,913, Response filed Mar. 2, 2004 to Restriction Requirement mailed Feb. 2, 2004", 1 pg.
"U.S. Appl. No. 09/492,913, Response filed Nov. 2, 2004 to Non-Final Office Action mailed Jun. 2, 2004", 24 pgs.
"U.S. Appl. No. 09/492,913, Response to Notification of Non-Compliant Appeal Brief filed May 19, 2008", 2 pgs.
"U.S. Appl. No. 09/492,913, Restriction Requirement mailed Feb. 2, 2004", 4 pgs.
"U.S. Appl. No. 09/795,829, 312 Amendment filed Feb. 21, 2006", 9 pgs.
"U.S. Appl. No. 09/795,829, Final Office Action mailed Aug. 9, 2002", 7 pgs.
"U.S. Appl. No. 09/795,829, Non Final Office Action mailed Jun. 11, 2003", 12 pgs.
"U.S. Appl. No. 09/795,829, Non Final Office Action mailed Jun. 28, 2001", 9 pgs.
"U.S. Appl. No. 09/795,829, Non Final Office Action mailed Dec. 11, 2001", 9 pgs.
"U.S. Appl. No. 09/795,829, Non Final Office Action mailed Dec. 23, 2002", 10 pgs.
"U.S. Appl. No. 09/795,829, Notice of Allowance mailed Jan. 21, 2004", 8 pgs.
"U.S. Appl. No. 09/795,829, Notice of Allowance mailed Jun. 24, 2004", 5 pgs.
"U.S. Appl. No. 09/795,829, Notice of Allowance mailed Nov. 14, 2003", 6 pgs.
"U.S. Appl. No. 09/795,829, Notice of Allowance mailed Nov. 21, 2005", 8 pgs.
"U.S. Appl. No. 09/795,829, Preliminary Amendment filed Feb. 28, 2001", 4 pgs.
"U.S. Appl. No. 09/795,829, PTO Response to 312 Amendment mailed Apr. 10, 2006", 2 pgs.
"U.S. Appl. No. 09/795,829, Response filed Mar. 24, 2003 to Non Final Office Action mailed Dec. 23, 2002", 15 pgs.
"U.S. Appl. No. 09/795,829, Response filed Jun. 11, 2002 to Non Final Office Action mailed Dec. 11, 2001", 10 pgs.
"U.S. Appl. No. 09/795,829, Response filed Sep. 28, 2001 to Non Final Office Action mailed Jun. 28, 2001", 6 pgs.
"U.S. Appl. No. 09/795,829, Response filed Oct. 14, 2003 to Non Final Office Action mailed Jun. 11, 2003", 14 pgs.
"U.S. Appl. No. 09/795,829, Response filed Nov. 12, 2002 to Final Office Action mailed Aug. 9, 2002", 5 pgs.

"U.S. Appl. No. 10/096,335, Comments on Statement of Reasons for Allowance filed Dec. 30, 2004", 1 pg.
"U.S. Appl. No. 10/096,335, Final Office Action mailed Jul. 15, 2003", 12 pgs.
"U.S. Appl. No. 10/096,335, Non Final Office Action mailed Feb. 11, 2004", 7 pgs.
"U.S. Appl. No. 10/096,335, Non Final Office Action mailed Oct. 3, 2002", 14 pgs.
"U.S. Appl. No. 10/096,335, Notice of Allowance mailed Nov. 18, 2004", 16 pgs.
"U.S. Appl. No. 10/096,335, Preliminary Amendment mailed Mar. 11, 2002", 1 pg.
"U.S. Appl. No. 10/096,335, Response filed Jan. 14, 2004 to Final Office Action mailed Jul. 15, 2003", 14 pgs.
"U.S. Appl. No. 10/096,335, Response filed Apr. 3, 2003 to Non Final Office Action mailed Oct. 3, 2002", 14 pgs.
"U.S. Appl. No. 10/096,335, Response filed Jun. 10, 2004 to Non Final Office Action mailed Feb. 11, 2004", 11 pgs.
"U.S. Appl. No. 10/096,335, Supplemental Notice of Allowability mailed Dec. 27, 2004", 3 pgs.
"U.S. Appl. No. 10/112,965, Advisory Action mailed Apr. 17, 2003", 2 pgs.
"U.S. Appl. No. 10/112,965, Final Office Action mailed Jan. 27, 2003", 11 pgs.
"U.S. Appl. No. 10/112,965, Non Final Office Action mailed Sep. 23, 2002", 11 pgs.
"U.S. Appl. No. 10/112,965, Notice of Allowance mailed Jun. 6, 2003", 5 pgs.
"U.S. Appl. No. 10/112,965, Response filed Mar. 27, 2003 to Final Office Action mailed Jan. 27, 2003", 7 pgs.
"U.S. Appl. No. 10/112,965, Response filed Nov. 19, 2002 to Non Final Office Action mailed Sep. 23, 2002", 6 pgs.
"U.S. Appl. No. 10/241,764, Final Office Action mailed Jun. 11, 2003", 9 pgs.
"U.S. Appl. No. 10/241,764, Non Final Office Action mailed Jan. 8, 2004", 9 pgs.
"U.S. Appl. No. 10/241,764, Non Final Office Action mailed Jan. 15, 2003", 12 pgs.
"U.S. Appl. No. 10/241,764, Notice of Allowance mailed Sep. 29, 2004", 16 pgs.
"U.S. Appl. No. 10/241,764, Preliminary Amendment filed Sep. 10, 2002", 2 pgs.
"U.S. Appl. No. 10/241,764, Response filed Apr. 14, 2003 to Non Final Office Action mailed Jan. 15, 2003", 13 pgs.
"U.S. Appl. No. 10/241,764, Response filed Jun. 8, 2004 to Non Final Office Action mailed Jan. 8, 2004", 11 pgs.
"U.S. Appl. No. 10/241,764, Response filed Sep. 11, 2003 to Final Office Action mailed Jun. 11, 2003", 5 pgs.
"U.S. Appl. No. 10/698,333, Non Final Office Action mailed Aug. 3, 2004", 12 pgs.
"U.S. Appl. No. 10/698,333, Notice of Allowance mailed Dec. 8, 2004", 7 pgs.
"U.S. Appl. No. 10/698,333, Preliminary Amendment filed Jun. 3, 2004", 6 pgs.
"U.S. Appl. No. 10/698,333, Response filed Nov. 3, 2004 to Non Final Office Action mailed Aug. 3, 2004", 9 pgs.
"U.S. Appl. No. 10/698,333, Supplemental Notice of Allowability mailed Feb. 11, 2005", 2 pgs.
"U.S. Appl. No. 10/698,333, Supplemental Notice of Allowability mailed Mar. 1, 2005", 2 pgs.
"U.S. Appl. No. 10/698,333, Supplemental Preliminary Amendment filed Jun. 22, 2004", 6 pgs.
"U.S. Appl. No. 10/842,246, 312 Amendment filed Nov. 30, 2009", 5 pgs.
"U.S. Appl. No. 10/842,246, Advisory Action mailed Jul. 20, 2009", 3 pgs.
"U.S. Appl. No. 10/842,246, Ex Parte Quayle Action mailed Apr. 3, 2009", 9 pgs.
"U.S. Appl. No. 10/842,246, Examiner Interview Summary filed Sep. 9, 2009", 1 pg.
"U.S. Appl. No. 10/842,246, Examiner Interview Summary mailed Jun. 30, 2009", 2 pgs.
"U.S. Appl. No. 10/842,246, Non-Final Office Action mailed Nov. 6, 2008", 13 pgs.
"U.S. Appl. No. 10/842,246, Notice of Allowance mailed Oct. 1, 2009", 8 pgs.
"U.S. Appl. No. 10/842,246, Notice of Allowance mailed Nov. 12, 2009", 9 pgs.
"U.S. Appl. No. 10/842,246, Response filed Mar. 6, 2009 to Non-Final Office Action mailed Nov. 6, 2008", 7 pgs.
"U.S. Appl. No. 10/842,246, Response filed Aug. 8, 2008 to Restriction Requirement mailed Jul. 2, 2008", 8 pgs.
"U.S. Appl. No. 10/842,246, Response filed Jun. 10, 2009 to Ex parte Quayle Office Action mailed Apr. 3, 2009", 6 pgs.
"U.S. Appl. No. 10/842,246, Restriction Requirement mailed Jul. 2, 2008", 7 pgs.
"U.S. Appl. No. 10/842,246, Supplemental Notice of Allowability mailed Oct. 15, 2009", 3 pgs.
"U.S. Appl. No. 11/036,197, Advisory Action mailed Mar. 18, 2008", 3 pgs.
"U.S. Appl. No. 11/036,197, Advisory Action mailed Apr. 3, 2007", 3 pgs.
"U.S. Appl. No. 11/036,197, Final Office Action mailed Jan. 2, 2008", 13 pgs.
"U.S. Appl. No. 11/036,197, Final Office Action mailed Jan. 23, 2007", 13 pgs.
"U.S. Appl. No. 11/036,197, Non Final Office Action mailed Jun. 4, 2007", 11 pgs.
"U.S. Appl. No. 11/036,197, Non Final Office Action mailed Aug. 15, 2006", 24 pgs.
"U.S. Appl. No. 11/036,197, Notice of Allowance mailed Jul. 1, 2008", 6 pgs.
"U.S. Appl. No. 11/036,197, Preliminary Amendment mailed May 23, 2005", 5 pgs.
"U.S. Appl. No. 11/036,197, Response filed Mar. 3, 2008 to Final Office Action mailed Jan. 2, 2008", 8 pgs.
"U.S. Appl. No. 11/036,197, Response filed Mar. 23, 2007 to Final Office Action mailed Jan. 23, 2007", 10 pgs.
"U.S. Appl. No. 11/036,197, Response filed Oct. 4, 2007 to Non-Final Office Action mailed Jun. 4, 2007", 8 pgs.
"U.S. Appl. No. 11/036,197, Response filed Nov. 15, 2006 to Non Final Office Action mailed Aug. 15, 2006", 9 pgs.
"U.S. Appl. No. 11/036,197, Supplemental Preliminary Amendment filed Jul. 13, 2005", 5 pgs.
"U.S. Appl. No. 11/087,081, Non Final Office Action mailed Mar. 15, 2006", 6 pgs.
"U.S. Appl. No. 11/212,406, Final Office Action mailed Feb. 8, 2010", 27 pgs.
"U.S. Appl. No. 11/212,406, Final Office Action mailed May 18, 2007", 14 pgs.
"U.S. Appl. No. 11/212,406, Final Office Action mailed on Sep. 17, 2008", 24 pgs.
"U.S. Appl. No. 11/212,406, Non Final Office Action mailed Sep. 19, 2006", 13 pgs.
"U.S. Appl. No. 11/212,406, Non-Final Office Action mailed Feb. 4, 2008", 15 pgs.
"U.S. Appl. No. 11/212,406, Non-Final Office Action mailed Sep. 4, 2009", 23 pgs.
"U.S. Appl. No. 11/212,406, Response filed Feb. 19, 2007 to Non Final Office Action mailed Sep. 19, 2006", 15 pgs.
"U.S. Appl. No. 11/212,406, Response filed Jun. 4, 2008 to Non Final Office Action mailed Feb. 4, 2008", 13 pgs.
"U.S. Appl. No. 11/212,406, Response filed Jun. 17, 2009 to Final Office Action mailed Sep. 17, 2008", 15 pgs.
"U.S. Appl. No. 11/212,406, Response filed Oct. 31, 2007 to Final Office Action mailed May 18, 2007", 14 pgs.
"U.S. Appl. No. 11/212,406, Response filed Dec. 4, 2009 to Non Final Office Action mailed Sep. 4, 2009", 16 pgs.
"U.S. Appl. No. 11/331,827, Preliminary Amendment filed Jan. 13, 2006", 3 pgs.
"U.S. Appl. No. 12/553,857, Preliminary Amendment filed Dec. 18, 2009", 5 pgs.
"Canadian Application Serial No. 2,343,986, Office Action Mailed Dec. 12, 2008", 2 pgs.

"Canadian Application Serial No. 2,396,771, Office Action mailed Oct. 27, 2008", 5 pgs.
"Canadian Application Serial No. 2,506,957, Office Action mailed Apr. 14, 2008", 3 pgs.
"Canadian Application Serial No. 2223660, Office Action mailed May 5, 2008", 5 pgs.
"European Application Serial No. 05252864.3, Office Action mailed Apr. 29, 2009", 4 pgs.
"European Application Serial No. 05252864.3, Office Action mailed Oct. 13, 2008", 4 pgs.
"HI-PRO Hearing Instrument Programmer", *GN Otometrics A/S*, (Dec. 2000), 12 pgs.
"Microcard PCMCIA Programming Interface", [Online]. [Archived Oct. 17, 2002]. Retrieved from the Internet: <URL: www.hearing-aid.com/microcard.htm>, (Jun. 22, 2004), 2 pgs.
"Personal Programmer 2000: A Personal Programmer that's practically a PC in your hand!", [Online]. Retrieved from the Internet: <URL: http://www.siemens-hearing.com/products/pprods/persprogmain.html>, (Jun. 24, 1999), 3 pgs.
"Welcome Page", *Micro Audiometrics Corp.*, [Online]. Retrieved from the Internet: <URL:http://www.microaud.com>, (May 26, 1999), 17 pgs.
"What is PCMCIA", [Online]. Retrieved from the Internet: <URL: http://pw2.netcom.com/~ed13/pcmcia.html>, (Nov. 14, 1996), 3 pgs.
Anderson, Blane A., "A PCMCIA Card for Programmable Instrument Applications", *Tech-Topic, reprinted from The Hearing Review*, vol. 4, No. 9, (Sep. 1997), 47-48.
Armitage, Scott, et al., "Microcard: A new hearing aid programming interface", *Hearing Journal*, 51(9), (Sep. 1998), 37-32.
Bye, Gordon J, et al., "Portable Hearing-Related Analysis System", U.S. Appl. No. 10/698,333, filed Oct. 31, 2003, 90 pgs.
Clancy, David A, "Highlighting developments in hearing aids", *Hearing Instruments*, (Dec. 1995), 2.
Davis, Leroy, "Interface Between Data Terminal Equipment and Data Circuit Terminating Equipment Employing Serial Binary Data Interchange", www.interfacebus.com/Design_Connector_RS232.html, EIA-232 Bus, (Jul. 2, 2006), 1-6.
Eaton, Anthony M, et al., "Hearing Aid Systems", U.S. Appl. No. 09/492,913, filed Jan. 20, 2000, 56 pgs.
Griffing, Terry S, et al., "Acoustical Efficiency of Canal ITE Aids", *Audecibel*, (Spring 1983), 30-31.
Griffing, Terry S, et al., "Custom canal and mini in-the-ear hearing aids", *Hearing Instruments*, vol. 34, No. 2, (Feb. 1983), 31-32
Griffing, Terry S, et al., "How to evaluate, sell, fit and modify canal aids", *Hearing Instruments*, vol. 35, No. 2, (Feb. 1984), 3.
Hagen, Lawrence T, "Portable System for Programming Hearing Aids", U.S. Appl. No. 10/842,246, filed May 10, 2004, 53 pgs.
Ingrao, B., "Audiology Unplugged: Leading hearing care into the Bluetooth Age", *Hearing Review*, (Jan. 2006), 6 pgs.
Mahon, William J, "Hearing Aids Get a Presidential Endorsement", *The Hearing Journal.*, (Oct. 1983), 7-8.
Micro Audiometrics Corporation, "Micro Audiometrics Corporation Web Page", http://www/microaud.com, Internet webpage, (May 26, 1999), 11 pgs.
Sullivan, Roy F, "Custom canal and concha hearing instruments: A real ear comparison Part I", *Hearing Instruments*, vol. 40, No. 4, (Jul. 1989), 23-29.
Sullivan, Roy F, "Custom canal and concha hearing instruments: A real ear comparison Part II", *Hearing Instruments*, vol. 40, No. 7, (Jul. 1989), 30-36.
"Canadian Application No. 2601662, Office Action Mailed Feb. 8, 2010", 5 pgs.
"U.S. Appl. No. 10/842,246, Notice of Allowance mailed Mar. 24, 2010", 7 Pgs.
"U.S. Appl. No. 11/212,406 Non-Final Office Action mailed Jul. 19, 2010", 20 Pgs.
"Australian Application Serial No. 2007216810 , First Examiner Report mailed May 27, 2010", 2 Pgs.
"Canadian Application Serial No. 2601662, Office Action Response Filed Aug. 17, 2010", 9 pgs.
"U.S. Appl. No. 12/553,857, Non-Final Office Action mailed Sep. 29, 2010", 6 pgs.
"U.S. Appl. No. 12/553,857, Notice of Allowance mailed Dec. 13, 2010", 7 pgs.
"U.S. Appl. No. 12/553,857, Response filed Nov. 11, 2010 to Non Final Office Action mailed Sep. 29, 2010", 6 pgs.
"European Application Serial No. 97403015.7, Office Action mailed Jul. 30, 2010", 4 Pgs.
"U.S. Appl. No. 09/492,913, Examiner's Answer to Appeal Brief mailed Aug. 5, 2008", 32 pgs.
"U.S. Appl. No. 10/842,346, PTO Response to 312 Amendment mailed Feb. 1, 2010", 2 pgs.
"U.S. Appl. No. 11/087,081, Examiner Interview Summary mailed Oct. 26, 2006", 3 pgs.
"U.S. Appl. No. 11/212,406, Examiner Interview Summary Feb. 1, 2011", 3 pgs.
"U.S. Appl. No. 11/212,406, Final Office Action mailed Mar. 8, 2011", 23 pgs.
"U.S. Appl. No. 12/553,857, Supplemental Notice of Allowability mailed Feb. 7, 2011", 4 pgs.
"Australian Application Serial No. 2007216810 , First Examiner Report Response Filed Mar. 30, 2011", 3.
"Canadian Application Serial No. 2,223,660, Office Action mailed Feb. 1, 2005", 3 pgs.
"Canadian Application Serial No. 2,223,660, Response to Office Actions mailed May 5, 2008", 17 pgs.
"Canadian Application Serial No. 2,343,986, Office Action mailed May 9, 2007", 2 pgs.
"Canadian Application Serial No. 2,396,771, Office Action mailed Mar. 14, 2007", 7 pgs.
"Canadian Application Serial No. 2,396,771, Response filed Aug. 27, 2007 to Office Action mailed Mar. 14, 2007", 14 pgs.
"Canadian Application Serial No. 2,506,957, Response filed Oct. 14, 2008 to Office Action mailed Apr. 14, 2008", 8 pgs.
"Canadian Application Serial No. 2,601,662 , Office Action mailed Apr. 20, 2011", 4 pgs.
"Chinese Application Serial No. 200710186183.0, Office Action mailed Feb. 24, 2011", 7 pgs.
"Chinese Application Serial No. 200710186183.0, Office Action Received May 6, 2011", 8 pgs.
"European Application Serial No. 01942849.9, Office Action mailed Jan. 15, 2004", 6 pgs.
"European Application Serial No. 01942849.9, Office Action mailed Aug. 30, 2004", 1 pg.
"European Application Serial No. 01942849.9, Response filed Nov. 1, 2004 to Office Action mailed Aug. 30, 2004", 20 pgs.
"European Application Serial No. 01942849.9, Summons to Attend Oral Proceeding mailed Dec. 15, 2010", 5 Pgs.
"European Application Serial No. 05252864.3, European Office Action mailed May 18, 2011", 5 pgs.
"European Application Serial No. 05252864.3, Response filed Jul. 30, 2009 to Office Action mailed Apr. 29, 2009", 3 pgs.
"European Application Serial No. 07253666.7, Office Action mailed Nov. 26, 2010", 8 pgs.
"European Application Serial No. 07253666.7, response filed Mar. 29, 2011 to Office Action mailed Nov. 26, 2010", 21 pgs.
"European Application Serial No. 07253666.7, Response filed Sep. 30, 2009 to Office Action mailed Mar. 27, 2009", 14 pgs.
"European Application Serial No. 07253666.7, Response filed Nov. 15, 2007 to Office Action mailed Nov. 7, 2007", 10 pgs.
"European Application Serial No. 97403015.7, European Search Report mailed Sep. 19, 2001", 3 pgs.
"European Application Serial No. 97403015.7, Office Action mailed May 29, 2007", 5 pgs.
"European Application Serial No. 97403015.7, Response to Office Action mailed May 29, 2007", 8 pgs.
"European Application Serial No. 9951457.3, Response to Office Action mailed Jul. 14, 2004", 1 pgs.
"European Application Serial No. 9951457.3. Response to Office Action mailed Nov. 16, 2005", 21 pgs.
"European Application Serial No. 99951457.3, European Office Action mailed Jul. 14, 2004", 1 pgs.
"European Application Serial No. 99951457.3, European Search Report mailed Jul. 12, 2004", 3 pgs.

"European Application Serial No. 99951457.3, Office Action mailed Sep. 12, 2007", 4 pgs.
"European Application Serial No. 99951457.3, Office Action mailed Nov. 16, 2005", 10 pgs.
"European Application Serial No. 99951457.3, Response to Office Action mailed Mar. 4, 2008", 2 pgs.
"International Application Serial No. PCT/US01/01663, International Preliminary Examination Report mailed Jul. 18, 2002", 8 pgs.
"International Application Serial No. PCT/US01/01663, International Search Report mailed Nov. 19, 2001", 5 pgs.
"International Application Serial No. PCT/US01/01663, Written Opinion mailed May 3, 2002", 9 pgs.
"International Application Serial No. PCT/US99/21188, International Preliminary Examination Report mailed Mar. 27, 2001", 5 pgs.
"International Application Serial No. PCT/US99/21188, International Search Report mailed Dec. 13, 2001", 47 pgs.
"International Application Serial No. PCT/US99/21188, Written Opinion mailed Dec. 15, 2000", 8 pgs.
"U.S. Appl. No. 11/212,406, Response filed Sep. 7, 2011 to Final Office Action mailed Mar. 8, 2011", 15 pgs.
"Canadian Application Serial No. 2,601,662, Response filed Aug. 29, 2011 to Office Action mailed Apr. 20, 2011", 13 pgs.
"European Application Serial No. 05252864.3, European Office Action Response Filed Sep. 5, 2011", 2 pages.
"Chinese Application Serial No. 200710186183.0, Office Action mailed Mar. 19, 2012", With English Translation, 20 pgs.

* cited by examiner

WIRELESS INTERFACE FOR PROGRAMMING HEARING ASSISTANCE DEVICES

CROSS REFERENCE TO RELATED APPLICATIONS

This application claims the benefit of provisional U.S. patent application Ser. No. 60/845,565, filed on Sep. 18, 2006, which is hereby incorporated by reference in its entirety.

TECHNICAL FIELD

This disclosure relates generally to hearing assistance devices, and more particularly to wireless communication with hearing assistance devices.

BACKGROUND

Hearing assistance devices, including hearing aids, for use in the ear, in the ear canal, completely in the canal, and behind the ear, have been developed to ameliorate the effects of hearing losses in individuals. Hearing deficiencies can range from deafness to hearing losses where the individual has impairment responding to different frequencies of sound or to being able to differentiate sounds occurring simultaneously. The hearing assistance device in its most elementary form usually provides for auditory correction through the amplification and filtering of sound provided in the environment with the intent that the individual hears better than without the amplification. Hearing assistance devices are electronic devices that provide signal processing functions such as noise reduction, amplification, and tone control. In many hearing assistance devices these and other functions can be programmably varied to fit the requirements of individual users.

One limitation of current hearing assistance device devices is that a user cannot, and current devices cannot themselves, reprogram hearing assistance device properties and communicate with a hearing assistance device to adapt to changing conditions such as the environment in which the hearing assistance device is used without the device being in wired communication with a computer. With the introduction of improved wireless communication between devices, it is now possible to reprogram or communicate with an electronic device anywhere. The introduction of wireless communication networks, specifically Local Area Networks (LAN) has expanded the options available to device manufacturers and consumers. Also, with the existence of multiple wireless communication protocols, there is a need for such an improved wireless communication with hearing assistance devices to quickly and easily adapt to existing and changing wireless communication protocols.

Therefore, there is a need in the art to provide a portable device that can communicate wirelessly, using any wireless protocol, with a hearing assistance device regardless of the physical location of a user.

SUMMARY

The present subject matter provides a means for wireless electronic communication with one or more hearing assistance devices. The system provides an interface through which parameters of a hearing assistance device can be either manually or automatically updated. For instance, the hearing assistance device can be updated with changing conditions in the environment of a user. In order for this interface to be used with any available hearing assistance device that supports wireless communication, the system must be easily adapted to support differing wireless protocols. A device is provided herein which allows for easy adaptation of the wireless protocols of a portable wireless hearing assistance device communication system.

Disclosed herein, among other things, is a device for wirelessly communicating with a hearing assistance device. According to various embodiments, the device includes a first interface for communicating with a programmer, the programmer adapted to wirelessly communicate with a computer for programming a hearing assistance device. The device also includes a second interface for wirelessly communicating with a hearing assistance device. The second interface is adapted to receive a plurality of communication modules. Each of the modules is adapted for communication with at least one specific type of hearing assistance device. The device includes a housing for the first interface, the second interface, and electrical connections between the interfaces. The housing adapted to be worn around the neck of a person wearing the hearing assistance device.

Disclosed herein, among other things, is a portable system adapted for wireless communication with one or more hearing assistance devices. According to various embodiments, the system includes a programmer for communicating with an external source for programming a hearing assistance device. The system also includes a device for wireless communication with the hearing assistance device, including an upper unit and a lower unit. The upper unit is adapted to receive a plurality of communication modules, each communication module supporting at least one communication protocol for communicating with the hearing assistance device. The lower unit has an interface for communicating with the programmer to assist in communications between the source and the hearing assistance device. The system also includes an electrical connection between the upper unit and the lower unit and a housing enclosing the upper unit, lower unit and connection. The housing is adapted to be worn by a person wearing the hearing assistance device. The housing is further adapted to provide protection from the elements for the upper unit, lower unit and connections. In an additional embodiment, the housing is adapted to physically connect to the programmer, such as a NOAHlink device, and has a connection for receiving power from the NOAHlink device. In this embodiment, the upper and lower units do not contain a power source.

Disclosed herein, among other things, is a method for wirelessly programming a hearing assistance device. A device is provided having a plurality of communication modules removably attached to an upper unit of the device. The modules support a plurality of communication protocols. A lower unit of the device communicates with a programmer. Using a communication module in the upper unit of the device, the device communicates with a hearing assistance device using at least one of the communication protocols. This communication assists in programming the hearing assistance device from an external source that communicates with the programmer.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

Various embodiments are illustrated by way of example in the figures of the accompanying drawings. Such embodiments are demonstrative and not intended to be exhaustive or exclusive representations of the present subject matter.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and therefore not exhaustive, and the scope of the present subject matter is defined by the appended claims and their legal equivalents.

The present subject matter includes a portable system adapted for wireless communication with one or more hearing assistance devices. The system provides a convenient way for programming and/or adjusting parameters to customize a hearing assistance device while it is worn by a user. The system provides a physical connection to a programmer at one interface. The programmer is in communication with a source, such as a computer, with an input where changes to hearing assistance device parameters can be made. According to an embodiment, the programmer includes a NOAHlink device. At a second interface, technology modules (also referred to as "communication modules") can be plugged or inserted. Wireless communication with the hearing assistance device is initiated at this second interface. Each module supports at least one communication protocol for communicating with at least one hearing assistance device. By plugging or inserting different communication modules in the second interface, wireless communications can be established with a plurality of different hearing assistance devices manufactured by a plurality of different hearing aid manufacturers. According to various embodiments, communications modules are provided by the individual manufacturers of the hearing assistance devices, and are activated by that manufacturer's fitting software.

Figure 1B:
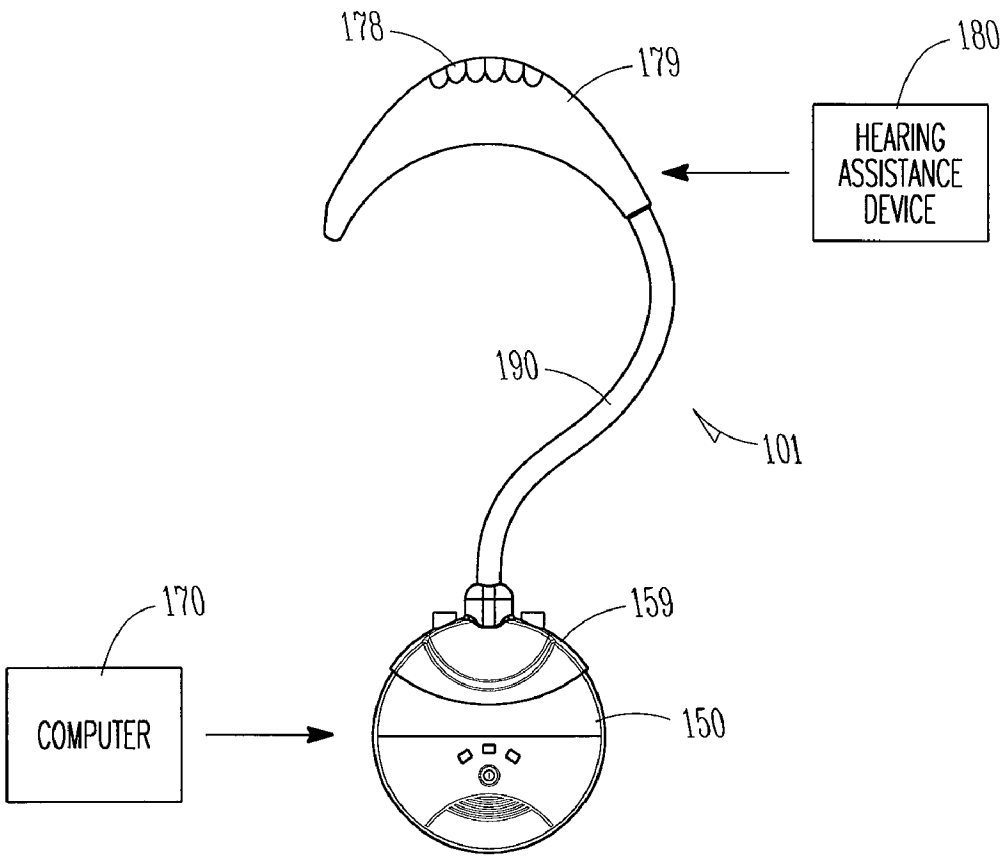
FIG. 1B illustrates an embodiment of a system including a wireless accessory module (WAM) device for programming a hearing assistance device.
Figure 1A:
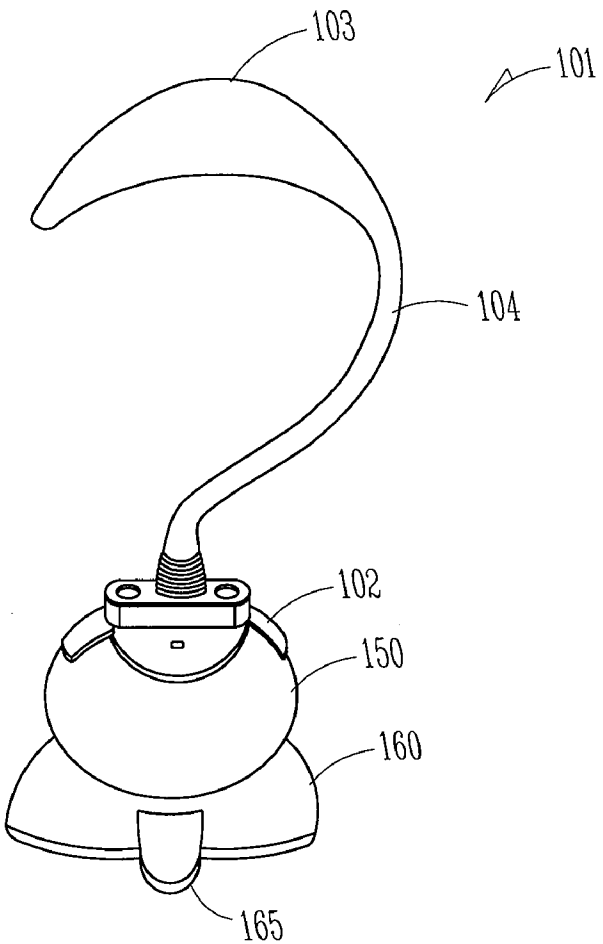
FIG. 1A illustrates an embodiment of a portable system adapted for wireless communication with one or more hearing assistance devices.

FIG. 1A illustrates an embodiment of a portable system adapted for wireless communication with one or more hearing assistance devices. In this embodiment, the portable system 101 includes: a lower unit 102 that provides connections and switching, an upper unit 103 to enable wireless communication with one or more hearing assistance devices, and a neck loop 104 used to conduct wires from the lower unit to the upper unit. In an embodiment, the neck loop includes a hook shaped flexible housing. The housing includes an elastomer housing, in an embodiment. The neck loop is used to place the unit on the body of a hearing-aid user. The neck loop provides rigidity while allowing for conformity to various patient body shapes. In an embodiment, the neck loop contains nine conductors plus a shield/common. The neck loop provides both the right and left channel lines to the upper unit backplane for further extensions, in various embodiments. In an embodiment, the lower unit contains switching and power management circuits as well as an LED as activity indicator. In an optional embodiment, the portable system also includes a battery charger. The portable system adapted for wireless communication with one or more hearing assistance devices is referred to herein as a wireless accessory module (WAM) system.

The lower unit 102 includes a plug in for a programmer 150. One embodiment of the programmer includes a NOAHlink device. In an embodiment, at least one 6-pin mini-DIN interface connector is used to connect to the programmer, and provides for a quick-disconnect capability. Additional holding force for the programmer is provided to supplement the pullout friction of the mini-DIM connectors in order to secure the assembly against accidental disassembly during handing, in an embodiment. In various embodiments, two six-pin mini-DIN female connectors are provided as pass-throughs in the lower unit 102, allowing the use of standard programming cables without removal of the WAM assembly from the programmer. Electrical connection between the upper and lower electronic units is accomplished by a nine-conductor shielded cable running within the conduit of neck loop 104, which allows the assembly to conform to the human anatomy by flexing at a stain relief located where the neck loop joins the lower unit. The upper unit 103 contains a microprocessor, supporting components, and a connector backplane to hold up to five technology (or communications) modules, as described. In various embodiments, additional numbers of technology modules can be held in the upper unit. In addition, a support member 165 is provided which attaches to the base of an electrical charger 160, to stabilize the charger against tipping due to additional weight and higher center of gravity caused by the WAM system. The WAM assembly obtains power from a battery in the programmer interface, requiring no additional power supply. The electrical charger 160 recharges the battery in the programmer in the depicted embodiment.

FIG. 1B illustrates an embodiment of a system including a WAM device for programming a hearing assistance device. When a hearing assistance device 180 is programmed while worn by a user, a computer 170 or other external source is used to enter the programming parameters. In various embodiments, computer 170 includes a personal computer in the form of a desk top computer, a laptop computer, a notebook computer, a hand-held computer device having a display screen, or any other computing device under the control of a program that has a display and an input device such as a mouse or keyboard. Further, computer 170 includes any processor capable of executing instructions for selecting parameters to program and/or fit a hearing assistance device. Various parameters in the hearing assistance device that can be adjusted during programming or fitting include, but are not limited to: band gain, channel gain (load and soft), output level, compression ratio, compression threshold knee points, grouped channel or band adjustments, volume control, expansion, noise management, feedback cancellation, and wind management.

The computer 170 communicates wirelessly with a programmer 162 using a designated protocol. In an embodiment, the programmer 162 includes a NOAHlink device using a standard NOAHlink protocol. The WAM device 101 includes a first interface 159 for communicating with a programmer. In the depicted embodiment, the WAM device 101 and the programmer 162 are physically connected at the interface. The WAM device 101 also includes a second interface 179 for wireless communicating with a hearing assistance device. The second interface 179 is adapted to receive a plurality of communication modules 179, each of the modules adapted for communication with at least one specific type of hearing assistance device. A housing 190 for the first interface, the second interface, and electrical connections between the interfaces, is included. The housing is adapted to be worn around the neck of a person wearing the hearing assistance device, and includes an elastomer in various embodiments. In an embodiment, the housing includes a housing for one or more printed circuit board assemblies to hold a microcontroller, switching components, power supply components, power conversion components, and additional supporting components.

The WAM device remains inactive until notified by the fitting software via the NOAHlink, allowing pass-through programming operation, in an embodiment. In various embodiments, the WAM device is an extension of the programmer, and has correspondingly the same approximate expected life cycle. The WAM device circuitry does not adversely load the programmer interface during wired programming operations. In various embodiments, the WAM device draws power from the programmer interface, requiring no additional power supply. The fitting software selects the WAM device and technology module through a discovery process, via onscreen selection, of using some combination of the two. Presence of hearing assistance devices, and the type and number (monaural or binaural) of devices is determined in software through a discovery process. The WAM system includes a physical address, according to various embodiments. WAM device and technology module firmware can be upgraded in the field via the programmer pathway. Each technology module has both a physical and wireless address, in an embodiment. The communication range of the WAM device is dependent upon the characteristics of the wireless link supported by the addressed communication module.

Figure 2A:
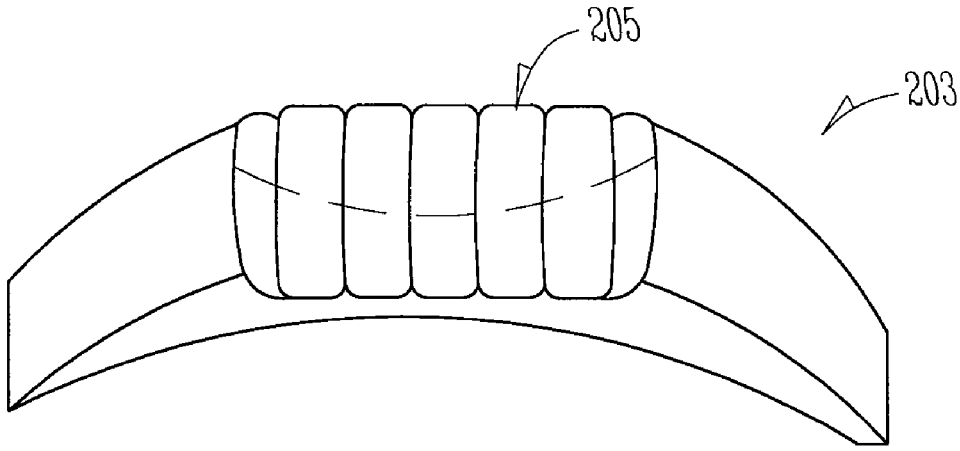
FIG. 2A illustrates an embodiment of the upper unit that enables wireless communication with one or more hearing assistance devices.
Figure 2B:
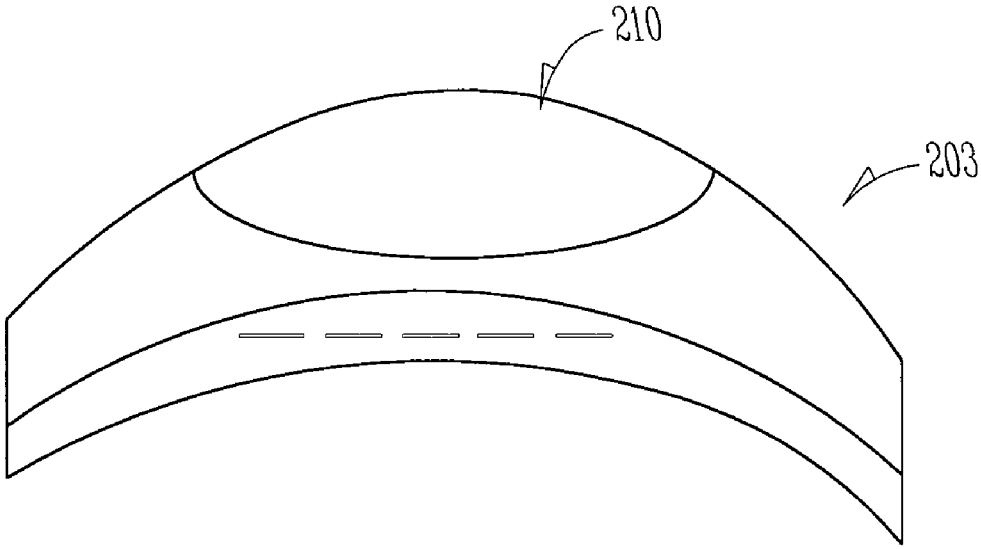
FIG. 2B illustrates an embodiment of the upper unit showing one embodiment of a cap for technology modules.

FIG. 2A and FIG. 2B illustrate an embodiment of the upper unit 203 that enables wireless communication with one or more hearing assistance devices. In an embodiment, the upper unit contains technology module management, electrical connections for technology modules, and housing for technology (communications) modules 205. In an embodiment, these technology modules 205 contain electric components that enable wireless communication using one or more wireless protocols. In various embodiments the wireless interface can include standard or nonstandard communications. Some examples of standard wireless interfaces include, but are not limited to, FM, AM, SSB, BLUETOOTH™, IEEE 802.11 (wireless LANs) wi-fi, 802.15 (WPANs), 802.16 (WiMAX), 802.20, and cellular protocols including, but not limited to CDMA and GSM, ZigBee, and ultra-wideband (UWB) technologies. Such protocols support radio frequency communications and some support infrared communications. It is possible that other forms of wireless interfaces can be used such as inductive, ultrasonic, optical, and others. It is understood that the standards which can be used include past and present standards. It is also contemplated that future versions of these standards and new future standards may be employed without departing from the scope of the present subject matter. In various embodiments using these interfaces, the hearing assistance device and a programmer (AKA a peripheral unit, such as the depicted NOAHlink 150 in FIG. 1A) are coupled for receiving the parameters from computer to provide programming signals to the hearing aid.

In an embodiment, the modules are identical in size and shape. In an embodiment, the modules are removable. In a further embodiment, the modules are easily removable by a user of the portable system. In an embodiment, the electrical connections for the technology modules are made through a standard connector such as (Molex SMT) with the CradleCon™ I/O Receptacle (part no. 51283-1416) in a backplane PCB for routing to a microcontroller as well as a regulator. In various embodiments, the electrical connections for the technology modules are made through any electrical connection. Any electrical connection now known or later discovered is considered within the scope of this application.

In the embodiment illustrated in FIG. 2A, five technology modules are shown. In this embodiment, the five technology modules enable the portable system to wirelessly communicate using at least five communications protocols. In an embodiment, the technology modules are covered through a click-on cap 210. The click-on cap allows access to the technology modules while protecting them against liquids and dust during use and storage. FIG. 2B illustrates one embodiment of a cap 210 for technology modules. By using removable and replaceable technology (communication) modules, the WAM device can be used to program hearing assistance devices of a variety of makes, modules and manufacturers.

Figure 3:
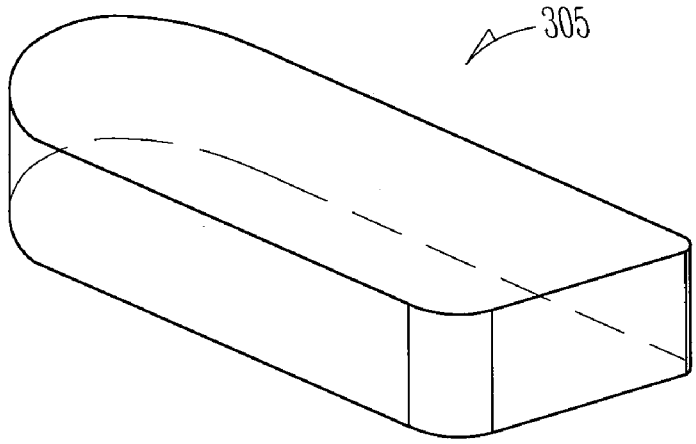
FIG. 3 illustrates an embodiment of the technology module.
Figure 11:
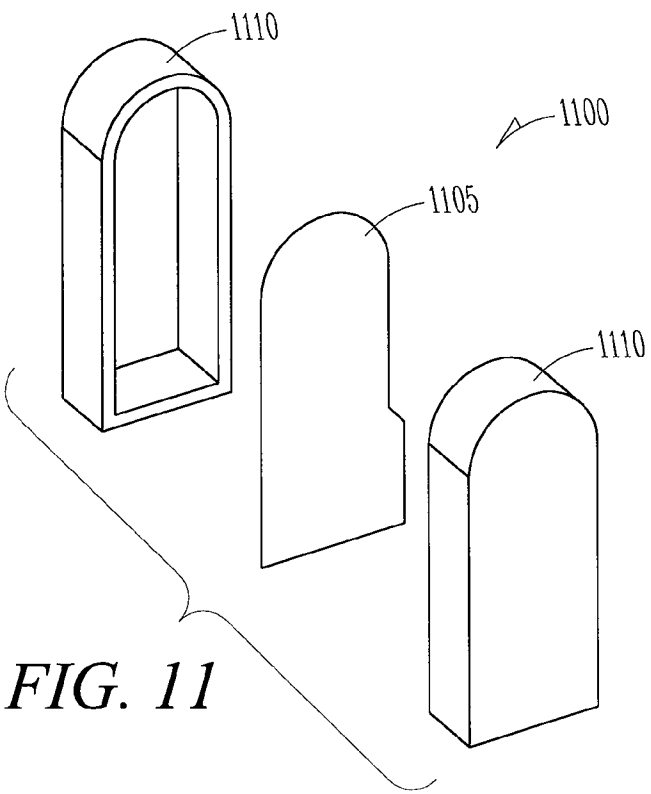
FIG. 11 illustrates an embodiment of a technology module assembly.
Figure 10:
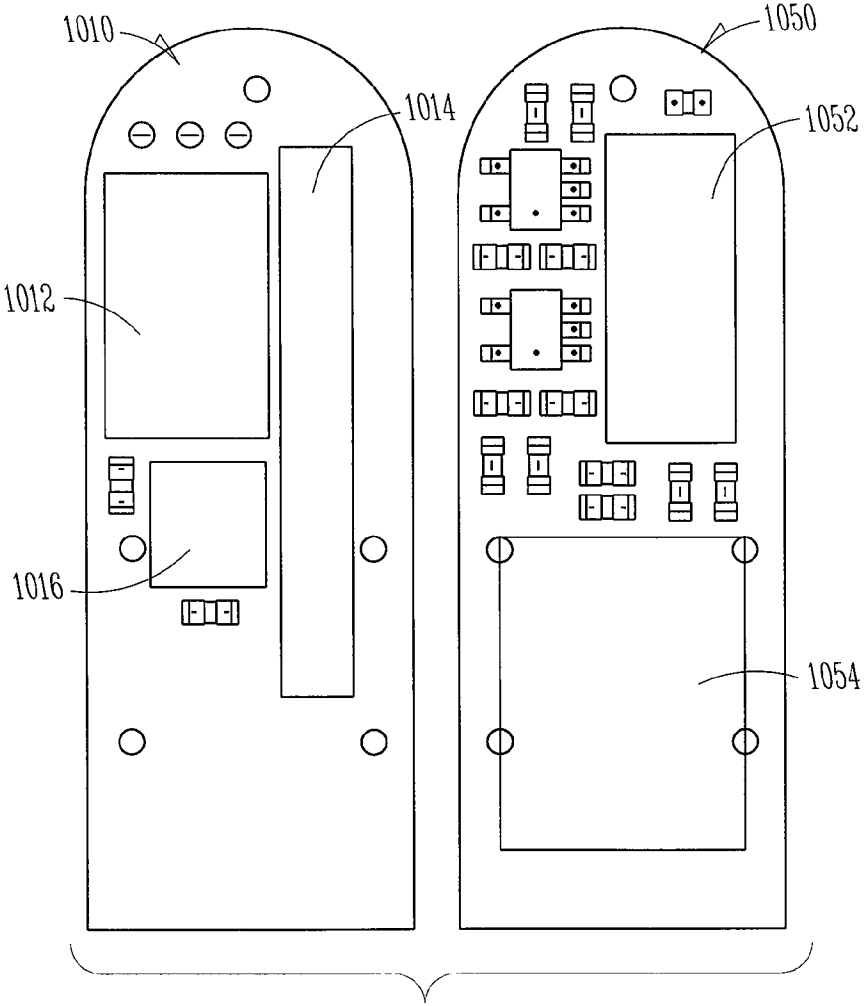
FIG. 10 illustrates an embodiment of a circuit board for a technology module.

FIG. 3 illustrates generally an embodiment of the technology (communications) module 305. In various embodiments, the technology modules are self contained and independent from the remaining components of the portable system. In this embodiment, the technology modules have a rectangular shape with a rounded top, and the dimensions of the technology module are 22 mm×9 mm×9 mm. Additional details of a technology module are shown in FIGS. 10 and 11. FIG. 10 illustrates an embodiment of a circuit board for a technology module. On a first side 1010 side of the circuit board, electronics for enabling communication with a hearing assistance device include hybrid circuit 1012, antenna 1014 and trimmer 1016. On a second side 1050 of the circuit board, additional components include crystal 1052 and cone 1054. FIG. 11 illustrates an embodiment of a technology module assembly. In the depicted embodiment, printed circuit board 1105 resides between first and second portions of plastic housing 1110.

Figure 4:
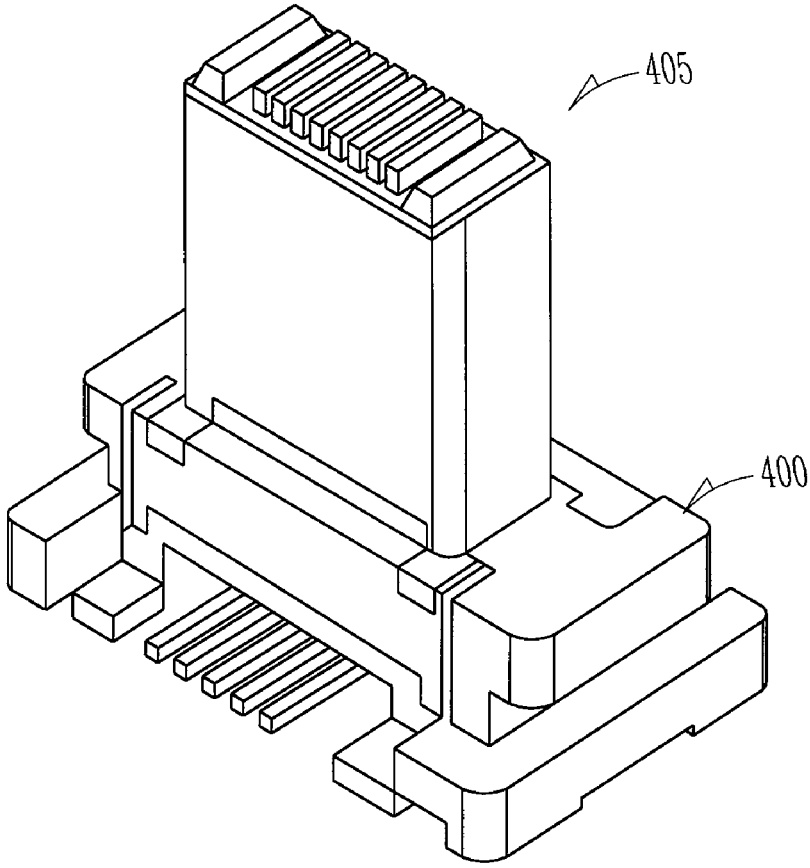
FIG. 4 illustrates an embodiment a standard connector in the upper unit for connecting the technology modules.

The technology modules can be connected to the electrical connections for the technology modules included in the upper unit by a standard connector on the tip of the module. FIG. 4 illustrates an example of such a standard connector 400, the CradleCon™ I/O Plug, (Part No. 501091-1470). The technology module 405 is shown seated in the standard connector 400. Technology modules plug into a backplane assembly PCB on the WAM device to provide vendor-specific wireless capability, in various embodiments. In an embodiment, the technology module includes a small printed circuit board along with a connector, antenna and supporting components enclosed in a plastic housing.

Figure 5A:
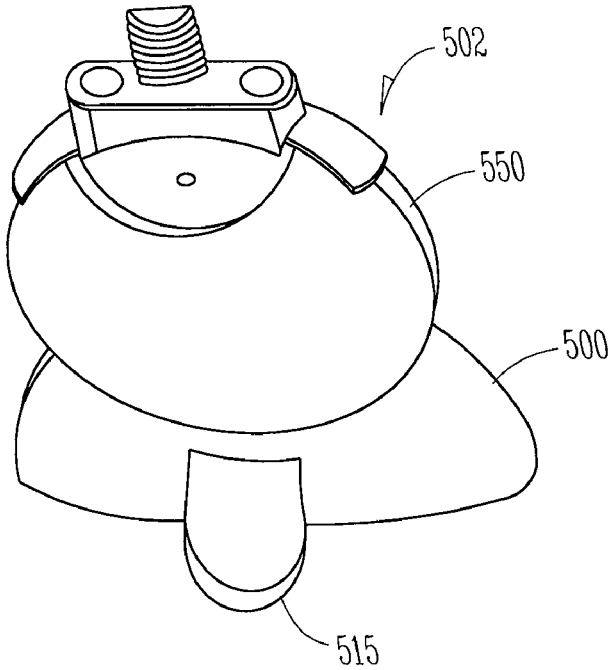
FIG. 5A illustrates an embodiment of battery charger that is used to power the portable system.
Figure 5B:
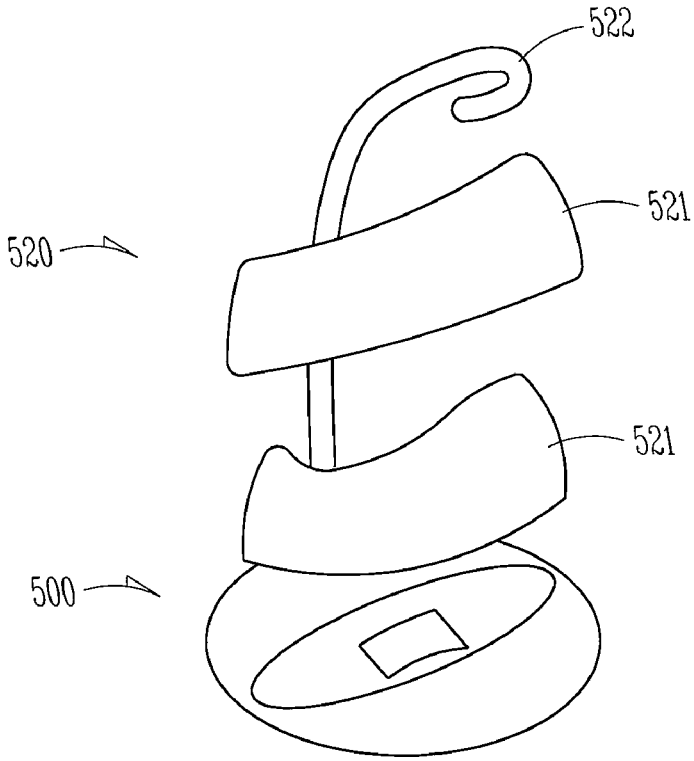
FIG. 5B illustrates an embodiment of battery charger with an additional charger base stabilizer.

FIGS. 5A and 5B illustrate additional components of the portable system. FIG. 5A illustrates an embodiment of battery charger 500 that is used to power the portable system. In this embodiment, the lower unit 502 with attached NOAHlink device 550 is fitted to stand in the battery charger 500. In this embodiment, the battery charger includes an additional foot 515 to prevent the portable system from falling over. FIG. 5B illustrates an embodiment of battery charger 500 with an additional charger base stabilizer 520. In one embodiment, the stabilizer 520 includes two additional support members 521 and a support hook 522 to provide support for the combined assembly when placed in the charger. The stabilizer permits the assembly to stand upright in the charger, so that the weight of the assembly does not cause it to tip.

Figure 6:
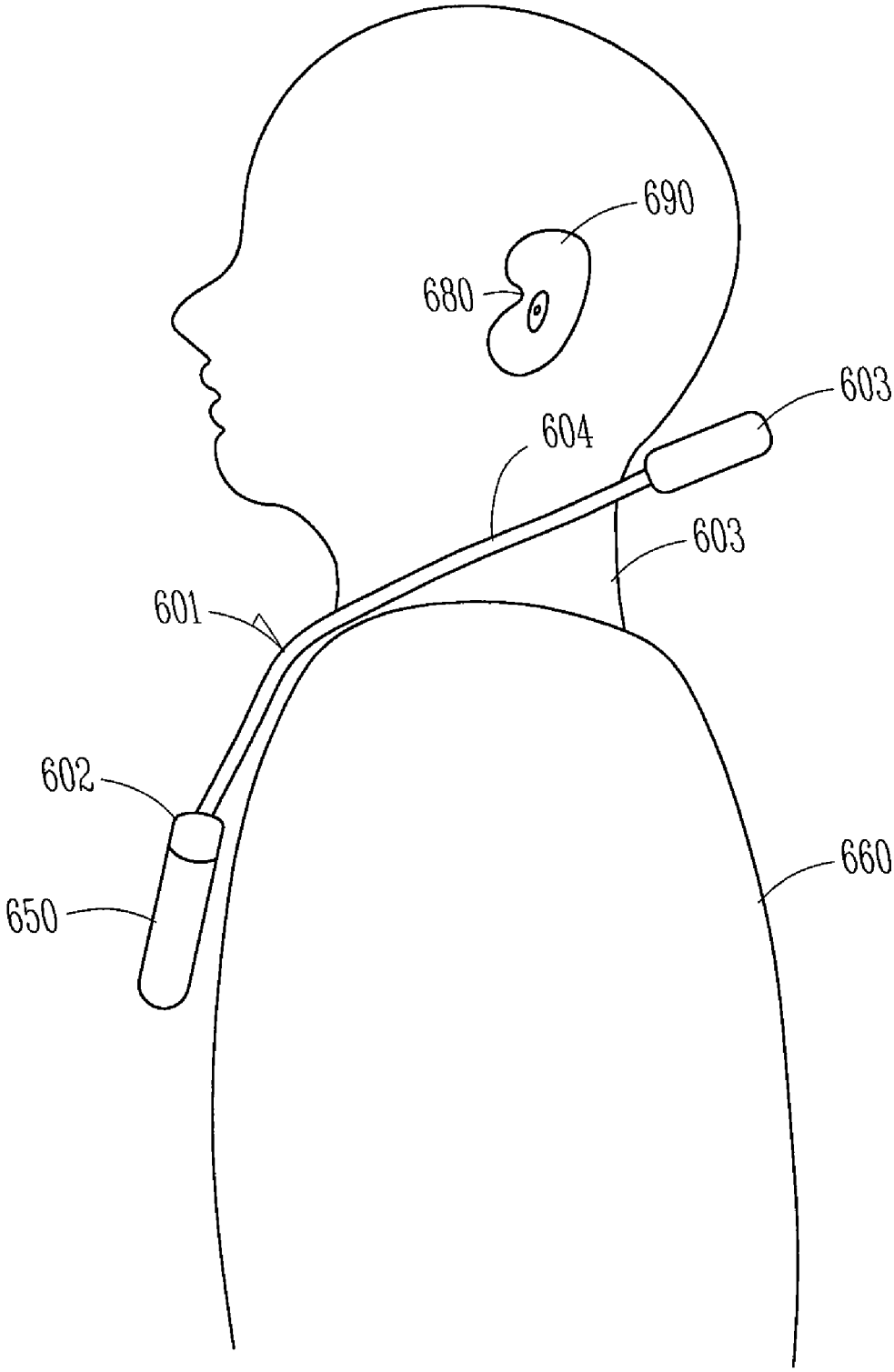
FIG. 6 illustrates an embodiment of a WAM device with attached programmer as worn by a user.

FIG. 6 illustrates an embodiment of a WAM device 601 with attached programmer 650 as worn by a user 660. The device includes a lower unit 602 connected to the programmer 650 and an upper unit 603 housing replaceable technology modules adapted to communicate with a hearing assistance device 680 worn in the user's ear 690. The device further includes a flexible neck loop portion 604 with conduit and electrical connections between the lower and upper units.

Figure 7:
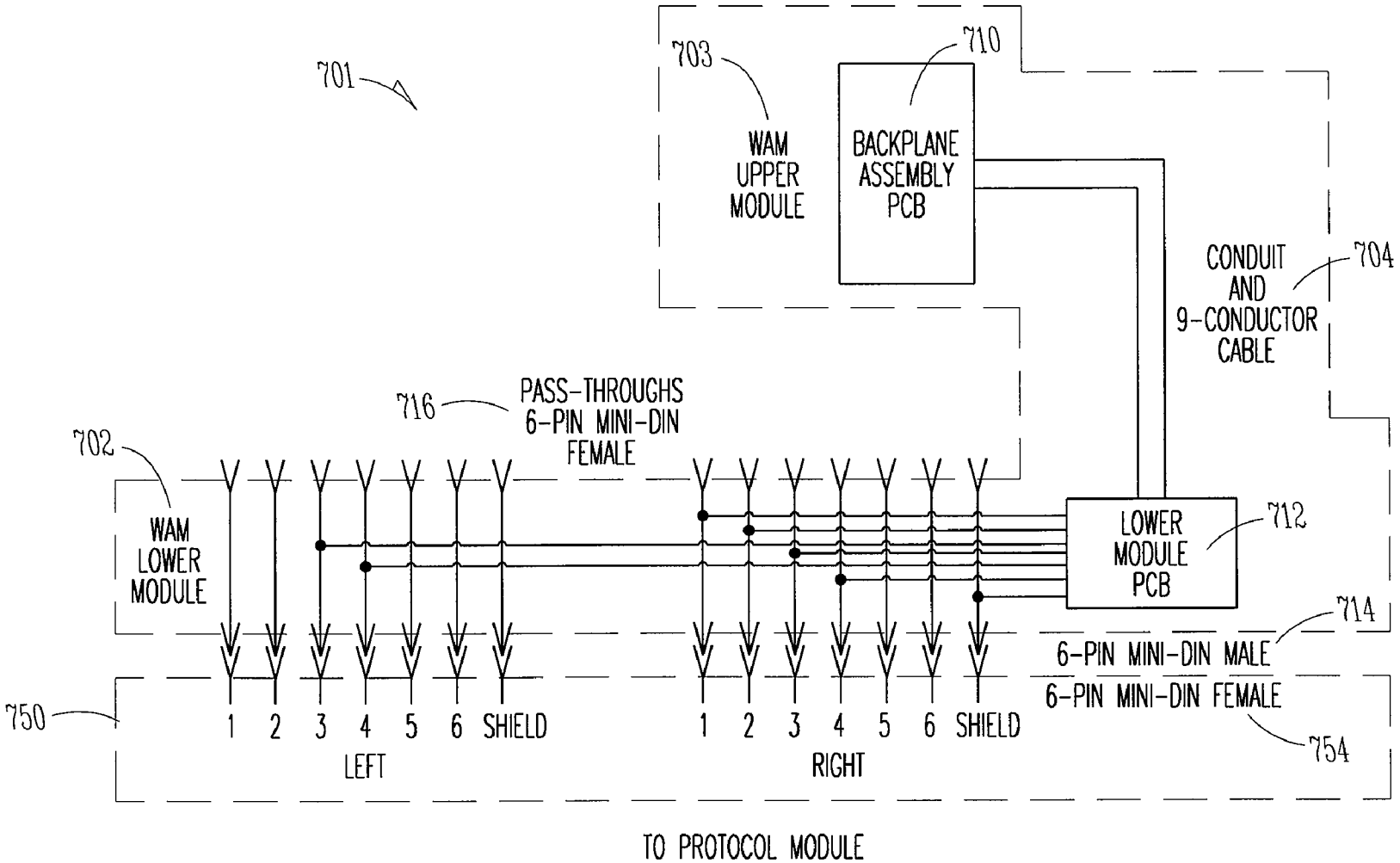
FIG. 7 illustrates an embodiment of interconnect wiring for the WAM device showing the interface to the programmer.

FIG. 7 illustrates interconnect wiring for the WAM device 701, showing the interface to the programmer 750. One embodiment of the programmer includes a NOAHlink device, but one of skill in the art will understand that the interface can be adapted for any present or future programmer. In an embodiment, the upper unit 703 of the WAM device includes a backplane assembly printed circuit board (PCB) 710 which provides for plugging in various technology modules and interfaces with conduit and connector cables in the neck loop portion 704. These cables connect the upper unit with a second printed circuit board 712 in the lower unit 702. Lower unit 702 includes the interface with the programmer 750. This interface includes two 6-pin mini-DIN connectors, with the male connectors 714 residing on the lower unit and the female connectors residing on the programmer, according to an embodiment. According to various embodiments, the lower unit 702 further includes pass-throughs for 6-pin mini-DIM female connectors, allowing the use of standard programming cables for wired communication with a hearing assistance device without removal of the WAM assembly from the programmer.

Figure 9A:
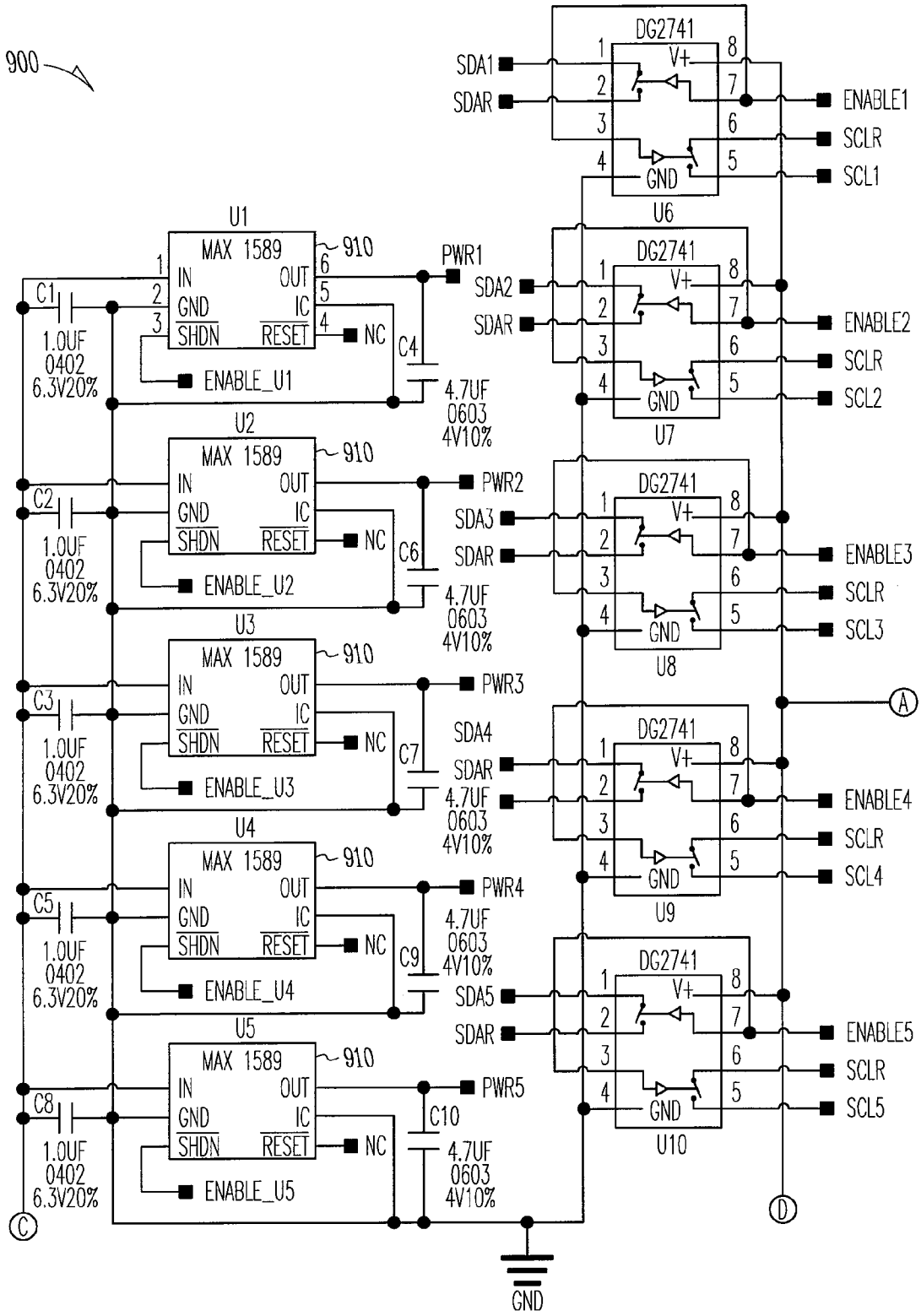
FIG. 9 illustrates a schematic diagram of an embodiment of the interface between a WAM device and communication modules.
Figure 9B:
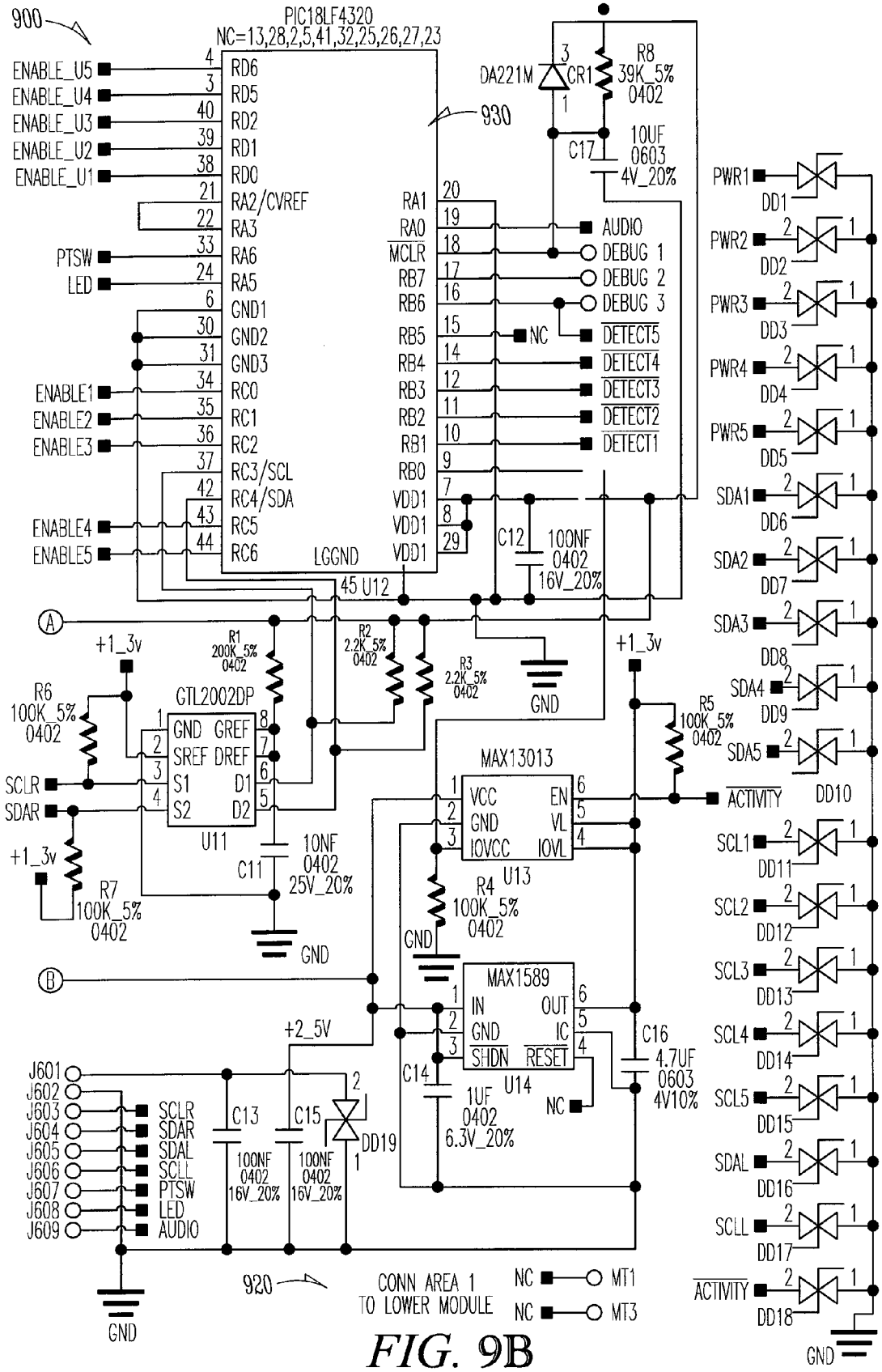
Figure 9C:
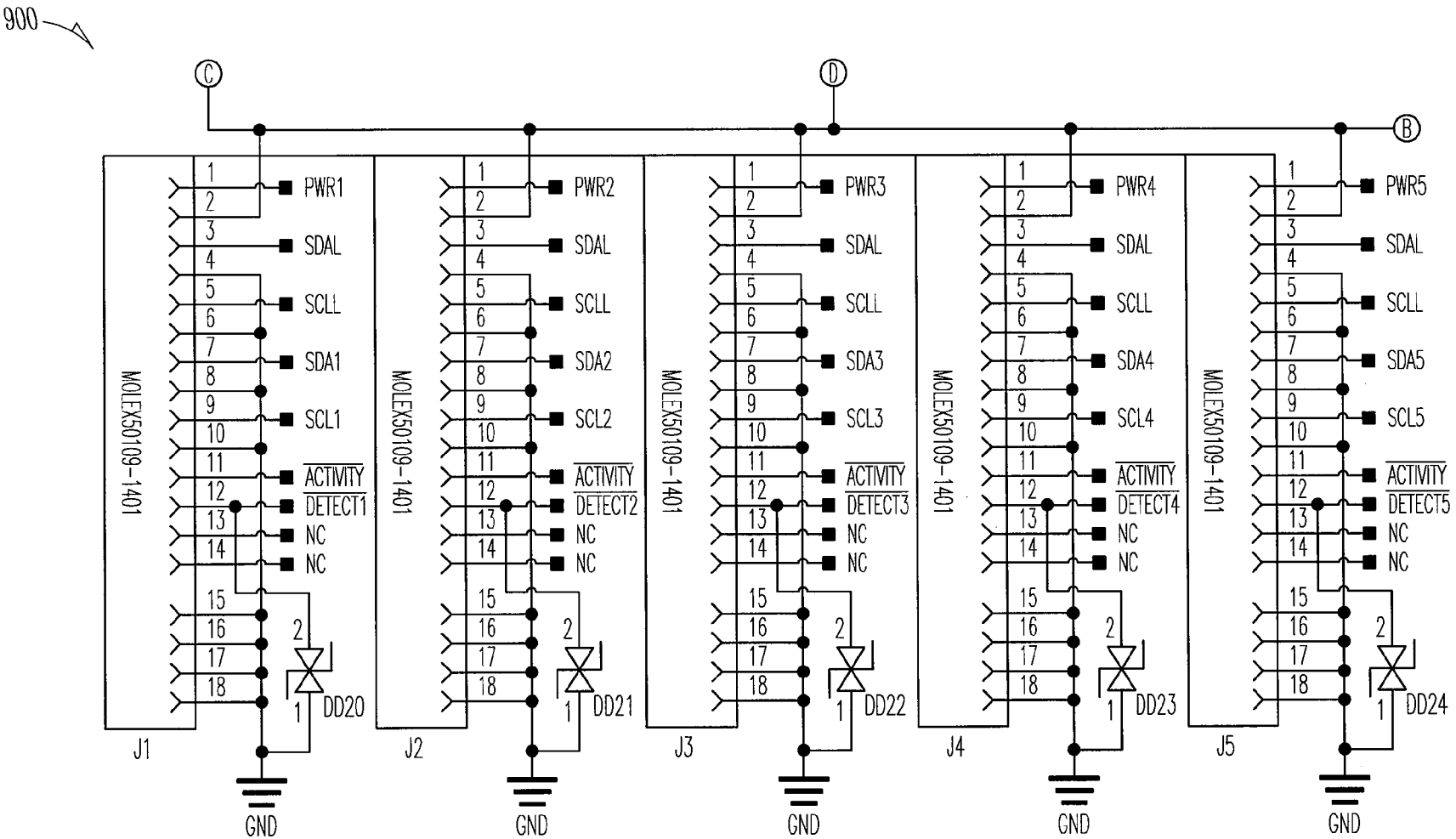

FIG. 9 illustrates a schematic diagram of an embodiment of the interface between a WAM device and communication (or technology) modules. A circuit 900 is shown providing an interface 910 for up to five technology modules, and a connection to the lower portion of the WAM assembly 920. A controller 930 directs communication between the WAM and the technology modules. In an embodiment, communication with the technology modules takes place via the standard $I^2C$ lines provided from the lower unit in the same way as for wired programming. The fitting system enables power to the lower unit connectors. In an embodiment, an analog audio line is used to initiate wireless programming in contrast to wired programming. In an embodiment, each technology module has a separate 1.3 V power supply and remain powered down until addressed by the microcontroller included in the lower unit. 2.5 V are available but are gated by the switched 1.3 V supply. In an embodiment, the right $I^2C$ lines are switched off when the respective module is not addressed in order to avoid interference with active units. The left $I^2C$ lines are not switched and require gating. Each slot will in addition be equipped with a dedicated technology module detection line, in various embodiments. The technology module uses a Molex SMT CradleCon I/O standard connector system, in an embodiment. Connector pins on the module include, but are not limited to, a power supply pin, a ground pin, $I^2C$ clock and data for left and right pins, Tx/Rx activity indicator, and module detections. The technology module operational environment includes switching from wired to wireless programming using analog audio lines. The fitting software initiates addressing of technology modules, and modules are completely switched off and decoupled when not in use, so that only one technology module is on at a time.

Software Implementation Embodiment

To implement the WAM device function of interfacing a programmer (such as a NOAHlink device in the embodiment below) and technology modules (which enable wireless communication with a hearing assistance device), one or more controllers are programmed with software. In an embodiment, the software provides a function summarized by the following operational outline. First, fitting software applies power to the NOAHlink right connector. The microcontroller then boots the system, performs a discovery process to determine which technology modules are present in the upper unit, and waits for instructions on an audio line. Fitting software sends a wakeup audio stream to the upper unit on the right audio line. In response, the microcontroller disables left and right pass-throughs in the lower unit (connected to the NOAHlink), routing left and right $I^2C$ lines from the NOAHlink to the upper unit bus, so the NOAHlink can communicate directly with the technology modules in the upper unit. The microcontroller reduces its own clock speed to save power, and waits for signals on the activity indicator line. Fitting software then can communicate with a technology module on either $I^2C$ bus. The technology module activates LED as required via the microcontroller, using the activity indicator line. At the end of the session, the fitting software rests the WAM by removing power from the NOAHlink connectors or by instructing the WAM processor, via $I^2C$, to enable the left and right pass-throughs.

In an embodiment, $I^2C$ addresses of the technology modules do not conflict and the addresses are coordinated. A minimum $I^2C$ data rate of 100 kbps is supported, and modules are rebooted and in idle mode within 0.5 sec after supplying power, in an embodiment. No additional power supply is used for the programmer, in an embodiment. According to various embodiments, one technology module is active at a given time. The maximum current consumption for a technology module is approximately 10 mA and quiescent current is approximately 1 mA, in an embodiment. In various embodiments the current consumption maximum for a module is 15 mA. According to various embodiments, technology modules are provided by the individual manufacturers of the hearing assistance devices, and are activated by that manufacturer's fitting software.

Software includes a software development kit (SDK) and firmware, in various embodiments. The SDK includes .NET assembly for $I^2C$-based communications with technology modules via NOAHlink services for technology module discovery and slot control, in an embodiment. In one embodiment, the SDK uses NOAHlink kernel and himsa.com components. The firmware component runs on a microcontroller in the upper unit of the device, and is used for technology module and slot discovery, including enabling and disabling slots, and gathering and displaying slot activity and statistics, in various embodiments.

The SDK for the wireless accessory module (WAM) device includes a software component that fitting software (software for fitting a hearing assistance device to a user) will incorporate in order to allow for control over a programmer (such as a NOAHlink) hearing instrument connector bypass mechanism within the WAM device, as well as detecting and supplying power to the respective technology module. Communications with one or several specific WAM technology modules will then be controlled by software components supplied by a technology module vendor, according to various embodiments. In an embodiment, a specific technology module is communicated with via $I^2C$ using an $I^2C$ address associated with a specific technology module. As mentioned, the address for each technology module is unique. A processor in the WAM module performs discovery and maintains a table of technology modules currently installed (or plugged-in) to the WAM device. The WAM microcontroller has direct access to the connector detect lines and can begin the discovery process when power is enabled on the NOAHlink connector. Modules are switched off and decoupled when not in use, and only one technology module is "on" at a given time, in various embodiments. In an embodiment, the WAM device permits hot swapping (plugging and unplugging while powered) of technology modules. Firmware for the WAM system runs on a microcontroller in the upper unit, in an embodiment. The firmware is used for, among other things, technology module and slot discovery, enabling and disabling slots and gathering and displaying slot activity and statistics.

Additional operations are provided in the WAM system software, according to various embodiments. According to an embodiment, a "fitting application request" operation is provided, in which the fitting application software (in a remote computer, for example) logs in to the WAM software development kit (SDK), powers up the NOAHlink, downloads NOAHlink firmware, enables power to the WAM device via the right NOAHlink connector, and initiates the WAM startup operation. An audio tone is sent via the WAM SDK to trigger the bypass, and the WAM processor disables the pass-through. The fitting application instructs the WAM processor to enable a slot that has a specific $I^2C$ address. The WAM processor searches for the address in the correlation table, and if the address is found, the slot is enables and a positive result is returned. Otherwise, if there are any occupied by uncorrelated slots, the WAM processor performs a one-byte $I^2C$ read using all valid $I^2C$ addresses. If a technology module responds to any address, that address is correlated with the slot in the table, the slot is enabled, and a positive result is returned. Otherwise, if all addresses are naked, a negative result is returned. This provides for hot-swapping of modules.

According to an embodiment, a "WAM startup" operation is provided, in which the WAM SDK enables power on the right NOAHlink connector, the WAM processor boots up, enables power for all slots, and waits approximately 500 milliseconds for all modules to boot up. The WAM processor iterates through all valid $I^2C$ addresses, performing a one byte $I^2C$ read to each address. If the read is acknowledged, the address is added to the list of valid addresses. For each occupied slot N, where N=1 to 5 in this embodiment, the slot N is disabled for each uncorrelated address in the list of valid address. A zero byte $I^2C$ read is attempted to the uncorrelated address. If the read is NACKed, that address is correlated with slot N. This step also detects if more than one slot is assigned the same $I^2C$ address. According to an embodiment, a "detect line goes 'unoccupied'" operation is provided, in which the WAM processor disables the power for the slot that went "unoccupied", and clears the table entry referenced by the "unoccupied" slot. A "detect line goes 'occupied'" operation is provided, in an embodiment. In this operation, the WAM processor marks the table entry of the address used by that slot as "uncorrelated". Keeping the power off forces communication failure if the application tries communicating.

According to one embodiment, certain procedures will be performed. According to other embodiments, other procedures will be performed. In one embodiment, the WAM processor will not check the audio bypass line until the startup operation is complete. This prevents $I^2C$ bus collision with the NOAHlink device, because the NOAHlink does not have multi-master support. The discovery process will be performed whenever the WAM powers up, even if only wired communication will be used. When the application actually opens the module for the first time, the WAM SDK can query the WAM processor to verify that the address is still valid. This allows detection of when technology module A is replaced by technology module B, which has a different $I^2C$ address. However, it does not detect the case where module A is replaced by a physically different module but of the same technology, which has the same $I^2C$ address. Soft configuration values would be lost, and use of slot detect lines would allow the WAM processor to power down a slot if the module was removed. The WAM processor would need to be reset to force the discovery process again. Hot swapping would not be transparent to the fitting application, in this instance.

Methods for Wirelessly Communication with Hearing Assistance Devices

Figure 8:
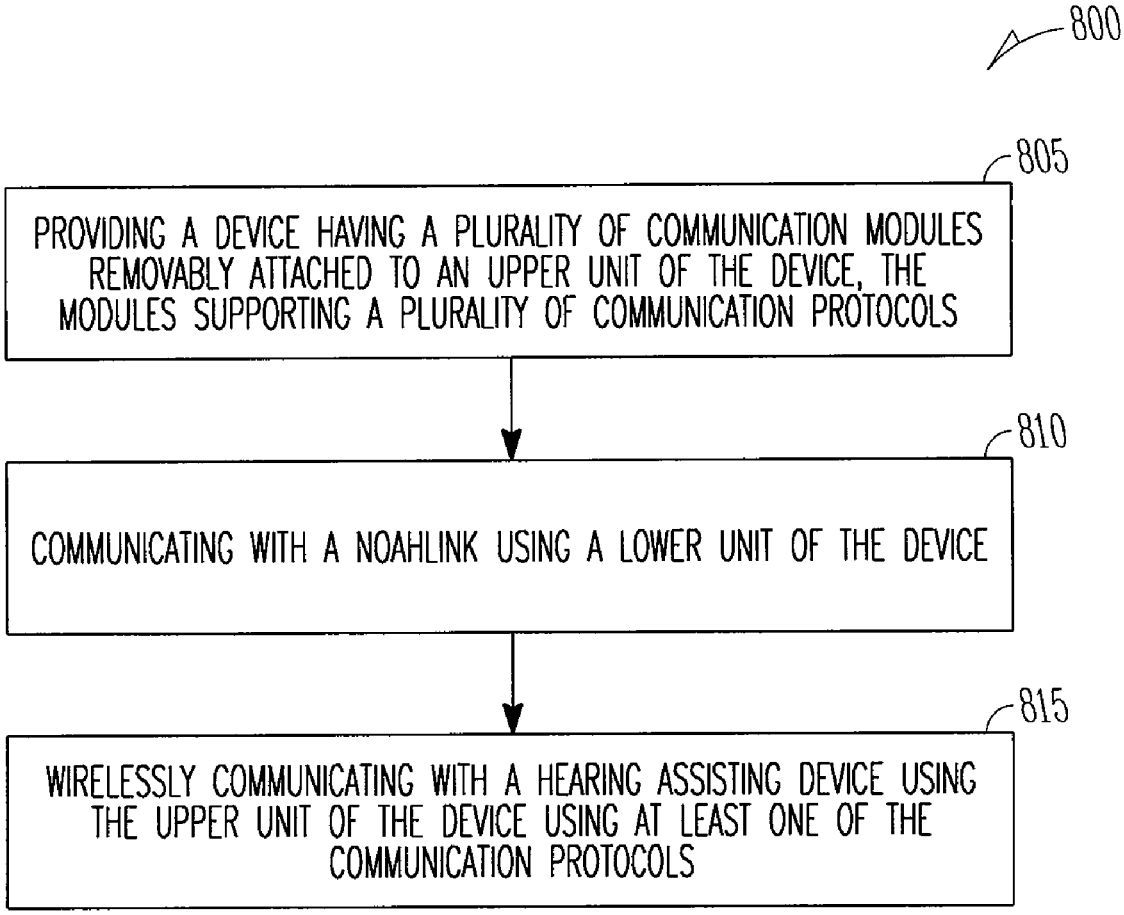
FIG. 8 illustrates a flow diagram of a method for wirelessly programming a hearing assistance device, according to one embodiment.

FIG. 8 illustrates a flow diagram of a method for wirelessly programming a hearing assistance device, according to one embodiment. An embodiment of the method includes providing a device having a plurality of communication modules removably attached to an upper unit of the device, at 805. The modules support a plurality of communication protocols. The method also includes communicating with a programmer using a lower unit of the device, at 810. The method further includes wirelessly communicating with a hearing assisting device using a communication module in the upper unit of the device using at least one of the communication protocols, at 815. The communication assists in programming the hearing assistance device from an external source that communicates with the programmer.

According to various embodiments, the method also includes providing a flexible conduit for housing electrical connections between the upper unit and the lower unit. In an embodiment, a neck loop is provided and adapted to be worn by a user of the hearing assistance device. The device provided includes a rechargeable power supply, in an embodiment. The method can further include recharging the rechargeable power supply without removing the supply from the system, using a recharging station having a base support member designed to prevent a tip over of the system. In an embodiment, the programmer includes a NOAHlink device, and the NOAHlink is physically connected to the lower unit of the device.

In an embodiment, each module supports at least one communication protocol for communicating with at least one hearing assistance device. By placing a different communication module in the upper unit, wireless communications can be established with a plurality of different hearing assistance devices manufactured by a plurality of different hearing aid manufacturers.

The disclosed WAM system addresses a need for a common programming platform for hearing assistance devices. By providing a physical and electrical connection to a programmer, and providing for the use of a number of proprietary technology modules (and thus protocols), the WAM system provides a standardized wireless interface that is seamless, universal and transparent to programming with cables. It allows for a use of multiple wireless technologies by use of a different module, and is thus easily adaptable for future updates and additional wireless protocols.

It is understood one of skill in the art, upon reading and understanding the present application will appreciate that variations of order, information or connections are possible without departing from the present teachings.

Additionally, one of ordinary skill in the art will understand that, the systems shown and described herein can be implemented using software, hardware, firmware, and combinations of thereof. As such, the term "system" is intended to encompass software implementations, hardware implementations, firmware implementations, and software and hardware and firmware implementations.

Although specific embodiments have been illustrated and described herein, it will be appreciated by those of ordinary skill in the art that other embodiments are possible without departing from the scope of the present subject matter.

We claim:

1. A device, comprising:

a first interface for communicating with a programmer, the programmer adapted to wirelessly communicate with a computer for programming a hearing assistance device;

a second interface for wirelessly communicating with the hearing assistance device, the second interface including a connector having multiple slots adapted to receive a plurality of hardware communication modules including a first hardware communication module adapted to support a first wireless communication protocol for communication with a first hearing assistance device and a second hardware communication module adapted to support a second wireless communication protocol for communication with a second hearing assistance device, wherein the second protocol is different from the first protocol; and a housing for the first interface, the second interface, and electrical connections between the interfaces, the housing adapted to be worn around the neck of a person wearing the hearing assistance device.

2. The device of claim 1, wherein the programmer is a NOAHlink device.

3. The device of claim 1, wherein the communication modules are adapted to wirelessly communicate with the hearing assistance device for programming the hearing assistance device.

4. The device of claim 1, wherein the housing includes a removable cap for covering the second interface.

5. The device of claim 1, wherein the second interface includes a microcontroller adapted to address the communication modules during communication with the hearing assistance device.

6. The device of claim 1, wherein the second interface is adapted to receive up to five different communication modules.

7. The device of claim 1, wherein the second interface communicates with the communication modules via $I^2C$ communication lines.

8. A system, comprising:

a programmer adapted to communicate with an external source for programming a hearing assistance device, and a device for wireless communication with the hearing assistance device, including:

an upper unit including a connector having multiple slots adapted to receive a plurality of hardware communication modules including a first hardware communication module supporting a first wireless communication protocol for communicating with a first hearing assistance device and a second hardware communication module supporting a second wireless communication protocol for communicating with a second hearing assistance device, wherein the second protocol is different from the first protocol;

a lower unit having an interface for communicating with the programmer to assist in communications between the source and the hearing assistance device;

an electrical connection between the upper unit and the lower unit; and a housing adapted to be worn by a person wearing the hearing assistance device, the housing enclosing the upper unit, lower unit and connection.

9. The system of claim 8, wherein the power supply is rechargeable.

10. The system of claim 9, wherein the rechargeable power supply is adapted to be recharged without removing the supply from the system, using a recharging station having a base support member designed to prevent a tip over of the system.

11. The system of claim 8, wherein the programmer is a NOAHlink device, and wherein the lower unit includes a 6-pin mini-DIN connector for connecting to the NOAHlink device.

12. The system of claim 8, wherein the lower unit includes a pass-through 6-pin mini-DIN connector, the connector adapted to provide a wired connection to the hearing assistance device.

13. The system of claim 8, wherein the upper unit is adapted to removably receive at least five communication modules.

14. The system of claim 13, wherein the communication modules are adapted to be received or removed without powering down the system.

15. A method, comprising:

providing a device including an upper unit having a connector with multiple slots adapted to receive a plurality of removably attachable hardware communication modules, the plurality of modules including a first hardware communication module supporting a first wireless communication protocol for communications with a first hearing assistance device and a second hardware communication module supporting a second wireless communication protocol for communications with a second hearing assistance device, wherein the second protocol is different from the first protocol;

communicating with a programmer using a lower unit of the device; and wirelessly communicating with the first hearing assisting device using the first hardware communication module in the upper unit of the device using the first communication protocol to assist in programming the first hearing assistance device.

16. The method of claim 15, further comprising:

providing a flexible conduit for housing electrical connections between the upper unit and the lower unit.

17. The method of claim 16, wherein providing a flexible connection includes providing a neck loop adapted to be worn by a user of the hearing assistance device.

18. The method of claim 15, wherein providing the device includes providing a rechargeable power supply.

19. The method of claim 18, further comprising:

recharging the rechargeable power supply without removing the supply from the system, using a recharging station having a base support member designed to prevent a tip over of the system.

20. The method of claim 15, wherein communicating with a programmer includes communicating with a NOAHlink device.

21. The method of claim 20, wherein communicating with a NOAHlink using a lower unit of the device includes physically connecting the lower unit of the device to the NOAHlink.

* * * * *

UNITED STATES PATENT AND TRADEMARK OFFICE

CERTIFICATE OF CORRECTION

PATENT NO. : 8,300,862 B2
APPLICATION NO. : 11/857283
DATED : October 30, 2012
INVENTOR(S) : Newton et al.

It is certified that error appears in the above-identified patent and that said Letters Patent is hereby corrected as shown below:

On the Title page, in column 1, under "Assignees (73)", line 1, delete "Inc," and insert --Inc.,--, therefor On the Title page, in column 2, under "Other Publications", line 1, after "Module", delete "." and insert --,--, therefor On Title page 5, in column 1, under "Other Publications", line 3, delete "Mailed" and insert --mailed--, therefor On Title page 5, in column 1, under "Other Publications", line 43, delete "mailed" and insert --filed--, therefor On Title page 6, in column 1, under "Other Publications", line 11, delete "mailed" and insert --filed--, therefor On Title page 6, in column 1, under "Other Publications", line 69, delete "filed" and insert --mailed--, therefor On Title page 6, in column 2, under "Other Publications", line 31, delete "mailed" and insert --filed--, therefor On Title page 6, in column 2, under "Other Publications", line 71, delete "Mailed" and insert --mailed--, therefor On Title page 7, in column 1, under "Other Publications", line 31, delete "J," and insert --J.,--, therefor On Title page 7, in column 1, under "Other Publications", line 33, delete "A," and insert --A.,--, therefor On Title page 7, in column 1, under "Other Publications", line 34, after "2", insert --pgs--, therefor Signed and Sealed this
Eleventh Day of November, 2014

Michelle K. Lee

Michelle K. Lee
*Deputy Director of the United States Patent and Trademark Office*

On Title page 7, in column 1, under "Other Publications", line 39, delete "M," and insert --M.,--, therefor On Title page 7, in column 1, under "Other Publications", line 41, delete "S," and insert --S.,--, therefor On Title page 7, in column 1, under "Other Publications", line 43, delete "S," and insert --S.,--, therefor On Title page 7, in column 1, under "Other Publications", line 45, delete "S," and insert --S.,--, therefor On Title page 7, in column 1, under "Other Publications", line 46, after "3", insert --pgs--, therefor On Title page 7, in column 1, under "Other Publications", line 47, delete "T," and insert --T.,--, therefor On Title page 7, in column 1, under "Other Publications", line 51, delete "J," and insert --J.,--, therefor On Title page 7, in column 1, under "Other Publications", line 56, delete "F," and insert --F.,--, therefor On Title page 7, in column 1, under "Other Publications", line 59, delete "F," and insert --F.,--, therefor On Title page 7, in column 1, under "Other Publications", line 62, delete "Mailed" and insert --mailed--, therefor On Title page 7, in column 1, under "Other Publications", line 66, after "11/212,406", insert --,--, therefor On Title page 7, in column 1, under "Other Publications", line 68, delete "2007216810 ," and insert --2007216810,--, therefor On Title page 7, in column 1, under "Other Publications", line 71, delete "Filed" and insert --filed--, therefor On Title page 7, in column 2, under "Other Publications", line 13, after "Summary", insert --mailed--, therefor On Title page 7, in column 2, under "Other Publications", line 19, delete "2007216810 ," and insert --2007216810,--, therefor On Title page 7, in column 2, under "Other Publications", line 20, delete "Filed" and insert --filed--, therefor On Title page 7, in column 2, under “Other Publications”, line 33, delete “2,601,662 ,” and insert --2,601,662,--, therefor On Title page 7, in column 2, under “Other Publications”, line 53, delete “response” and insert --Response--, therefor On Title page 7, in column 2, under “Other Publications”, line 66, delete “1 pgs.” and insert --1 pg.--, therefor On Title page 7, in column 2, under “Other Publications”, line 67, after “9951457.3”, delete “.” and insert --,--, therefor On Title page 7, in column 2, under “Other Publications”, line 70, delete “1 pgs.” and insert --1 pg.--, therefor On Title page 8, in column 2, under “Other Publications”, line 10, delete “Filed” and insert --filed--, therefor